US007423624B2

(12) United States Patent
Nose

(10) Patent No.: US 7,423,624 B2
(45) Date of Patent: Sep. 9, 2008

(54) HOLD TYPE IMAGE DISPLAY APPARATUS HAVING TWO STAGGERED DIFFERENT PIXELS AND ITS DRIVING METHOD

(75) Inventor: Takashi Nose, Kanagawa (JP)

(73) Assignee: NEC Electronics Corporation (JP)

( * ) Notice: Subject to any disclaimer, the term of this patent is extended or adjusted under 35 U.S.C. 154(b) by 765 days.

(21) Appl. No.: 10/807,638

(22) Filed: Mar. 24, 2004

(65) Prior Publication Data

US 2004/0189572 A1 Sep. 30, 2004

(30) Foreign Application Priority Data

Mar. 26, 2003 (JP) ..... 2003-086569

(51) Int. Cl.
*G09G 3/36* (2006.01)

(52) U.S. Cl. ..... 345/100; 345/522; 345/204; 345/92; 345/205; 345/206

(58) Field of Classification Search ..... 345/100, 345/92, 55, 204–206
See application file for complete search history.

(56) References Cited

U.S. PATENT DOCUMENTS 6,486,930 B1 * 11/2002 Kwon ..... 349/46

FOREIGN PATENT DOCUMENTS

CN 1278073 A 12/2000
JP 2000-122596 4/2000
JP 2001-027751 1/2001

OTHER PUBLICATIONS

Office Action issued by Chinese Patent Office on Feb. 2, 2007 in connection with corresponding application No. 200410008572.0 and English translation thereof.

(Continued)

*Primary Examiner*—Richard Hjerpe
*Assistant Examiner*—Leonid Shapiro
(74) *Attorney, Agent, or Firm*—Ostrolenk, Faber, Gerb & Soffen, LLP

(57) ABSTRACT

In a hold type image display apparatus, a panel includes a plurality of data lines, a plurality of gate lines, and first and second type pixels located at intersections between the data lines and the gate lines. Every one or more of the first type pixels and every one or more of the second type pixels are staggered at the intersections, wherein each of the first type pixels is connected to one of the data lines and two successive ones of the gate lines, and each of the second type pixels is connected to one of the data lines and one of the gate lines. A gate line driver circuit scans two first successive ones of the gate lines for writing first video data and two second successive ones of the gate lines for writing first black data in a first selection period and scans a preceding one of the first successive gate lines for writing second video data and a preceding one of the second successive gate lines for writing second black data in a second selection period. A data line driver circuit supplies the first video data and the first black data to the data lines in the first selection period, and supplies the second video data and the second black data to the data lines in the second selection period.

31 Claims, 27 Drawing Sheets

OTHER PUBLICATIONS

Taiichiro Kurita, "Degradation of Quality of Moving Images Displayed on Hold-Type Displays and Its Improving Method," 1999 Symposium of IEICE, pp. 207-208, 1999.

Office Action issued by Chinese Patent Office on Feb. 2, 2007 in connection with corresponding application No. 20041008572.0 and English translation thereof.

* cited by examiner 2
21
22
23
24
25
26
21m-/2
212
211
LAm/2
LA3
LA1
22m/2
222
221
Dm-1(Dm)
D3(D4)
D1(D2)
23m/2
232
231
LA
8
241m/2
243m/2
262m/2
24m
242m-1
2412
2432
2434
2423
2431
2422
2421
DAC
MPX
POL="1"
POL="0"
B+
B-
251
252
26m/2
2622
2612
2621
2611
DL_m
DL_m-1
DL_4
DL_3
DL_2
DL_1
DSL="0"
DSL="1"
HST
HCK
B0
B1
B7
VD
HSTB
POL
DSL 2'
21'
22'
23'
24'
25'
26'
21m/2
21(m/2-1)
211
212
LA1
LA2
LA(m/2-1)
LAm/2
221
222
22m/2
22(m/2-1)
Dm-2(Dm)
Dm-3(Dm-1)
D2(D4)
D1(D3)
23m/2
23(m/2-1)
232
231
241m/2
242m
242m-1
123m/2
2411
2421
2422
2431
251
252
253
POL="1"
POL="0"
B-
B+
POL
DAC
MPX
262m/4
261m/2
261(m/2-1)
2611
2612
2621
DSL="1"
DSL="0"
HST
HCK
VD
HSTB
DSL
DL1
DL2
DL3
DL4
DLm-3
DLm-2
DLm-1
DLm

HOLD TYPE IMAGE DISPLAY APPARATUS HAVING TWO STAGGERED DIFFERENT PIXELS AND ITS DRIVING METHOD

BACKGROUND OF THE INVENTION

1. Field of the Invention

The present invention relates to a hold type image display apparatus such as a liquid crystal display (LCD) apparatus and an electroluminescence (EL) display apparatus and its driving method.

2. Description of the Related Art

Generally, a hold type image display apparatus such as an LCD apparatus or an EL display apparatus is constructed by a plurality of data lines (or signal lines) driven by a data line driver circuit, a plurality of gate lines (or scan lines) driven by a gate line driver circuit, and pixels each located at one intersection between the data lines and the gate lines. In such a hold type image display apparatus, the quality of display deteriorates due to the residual image phenomenon caused by the low response speed and the hold operation. This will be explained later in detail.

In order to suppress the residual image phenomenon, a prior art hold type image display apparatus is suggested to supply video data to pixels on one gate line while supplying black data to pixels on another gate line (see: JP-A-2000-122596). This also will be explained later in detail.

In the above-described prior art hold type image display apparatus, however, the data line driver circuit is still large in scale and power consumption.

SUMMARY OF THE INVENTION

It is an object of the present invention to provide a hold type image display apparatus capable of suppressing the residual image phenomenon while reducing the scale and power consumption of a data line driver circuit.

Another object is to provide a panel, a gate line driver circuit and a data line driver circuit used in such a hold type image display apparatus.

A further object is to provide a driving method for driving such a hold type image display apparatus.

According to the present invention, in a hold type image display apparatus, a panel includes a plurality of data lines, a plurality of gate lines, and first and second type pixels located at intersections between the data lines and the gate lines. Every one or more of the first type pixels and every one or more of the second type pixels are staggered at the intersections, wherein each of the first type pixels is connected to one of the data lines and two successive ones of the gate lines, and each of the second type pixels is connected to one of the data lines and one of the gate lines. A gate line driver circuit scans two first successive ones of the gate lines for writing first video data and two second successive ones of the gate lines for writing first black data in a first selection period and scans a preceding one of the first successive gate lines for writing second video data and a preceding one of the second successive gate lines for writing second black data in a second selection period. A data line driver circuit supplies the first video data and the first black data to the data lines in the first selection period, and supplies the second video data and the second black data to the data lines in the second selection period.

Also, the data line driver circuit is constructed by a shift register circuit for receiving two horizontal start pulse signals per one horizontal period to shift the two horizontal start pulse signals in synchronization with a horizontal clock signal; a data register circuit for latching the first and second video data in synchronization with the latch signals; a digital/analog conversion circuit for performing digital/analog conversions upon the first and second video data latched in the data register circuit; a black data voltage generation circuit for generating at least one black data; and an output buffer circuit for multiplexing and supplying the first and second video data and the black data to the data lines. In this case, the shift register circuit includes serially-connected third flip-flops clocked by the horizontal clock signal to generate latch signals, the number of the third flip-flops being half of the number of the data lines.

Further, in a method for driving a hold type image display apparatus comprising a panel including a plurality of data lines, a plurality of gate lines, and first and second type pixels located at intersections between the data lines and the gate lines, every one or more of the first type pixels and every one or more of the second type pixels being staggered at the intersections, wherein each of the first type pixels is connected to one of the data lines and two successive ones of the gate lines, and each of the second type pixels is connected to one of the data lines and one of the gate lines, in a first selection period, two first successive ones of the gate lines for writing first video data and two second successive ones of the gate lines for writing first black data are scanned, and the first video data and the first black data are supplied to the data lines. Also, in a second selection period, a preceding one of the first successive gate lines for writing second video data and a preceding one of the second successive gate lines for writing second black data are scanned, and the second video data and the second black data are supplied to the data lines.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENTS

Before the description of the preferred embodiments, prior art LCD apparatuses will be explained with reference to FIGS. 1, 2, 3, 4, 5, 6, 7, 8, 9A, 9B, 10, 11, 12, 13, 14 and 15.

Figure 1:
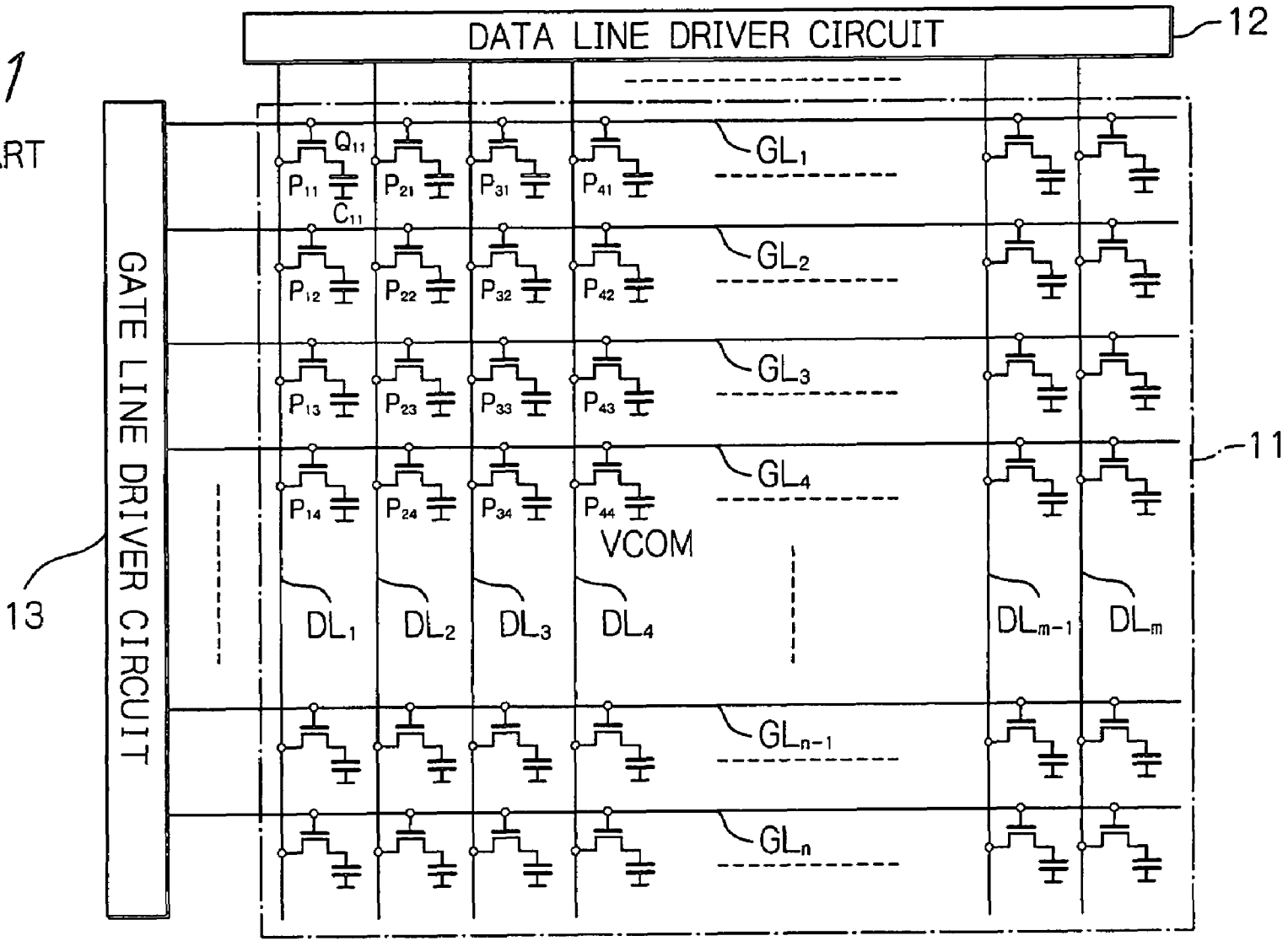
Fig. 1 PRIOR ART
FIG. 1 is a block circuit diagram illustrating a first prior art LCD apparatus.

In FIG. 1, which illustrates a first prior art LCD apparatus, reference numeral 11 designates an LCD panel having m×n dots where m is 640 and n is 480, for example. That is, the LCD panel 11 includes m data lines $DL_1$, $DL_2$, $DL_3$, $DL_4$, . . . , $DL_{m-1}$, $DL_m$ driven by a data line driver circuit 12, n gate lines $GL_1$, $GL_2$, $GL_3$, $GL_4$, . . . , $GL_{n-1}$, $GL_n$ driven by a gate line driver circuit 13, and m×n pixels $P_{ij}$ (i=1, 2, 3, 4, . . . , m−1, m; j=1, 2, 3, 4, . . . , n−1, n) each located at one intersection between the data lines $DL_1$, $DL_2$, $DL_3$, $DL_4$, . . . , $DL_{m-1}$, $DL_m$ and the gate lines $GL_1$, $GL_2$, $GL_3$, $GL_4$, . . . , $GL_{n-1}$, $GL_n$. Each of the pixels $P_{ij}$ is constructed by one thin film transistor (TFT) $Q_{ij}$ such as $Q_{11}$, one pixel capacitor $C_{ij}$ such as $C_{11}$ including liquid crystal connected between the TFT $Q_{ij}$ and a common electrode to which a common voltage VCOM is applied.

Figure 2:
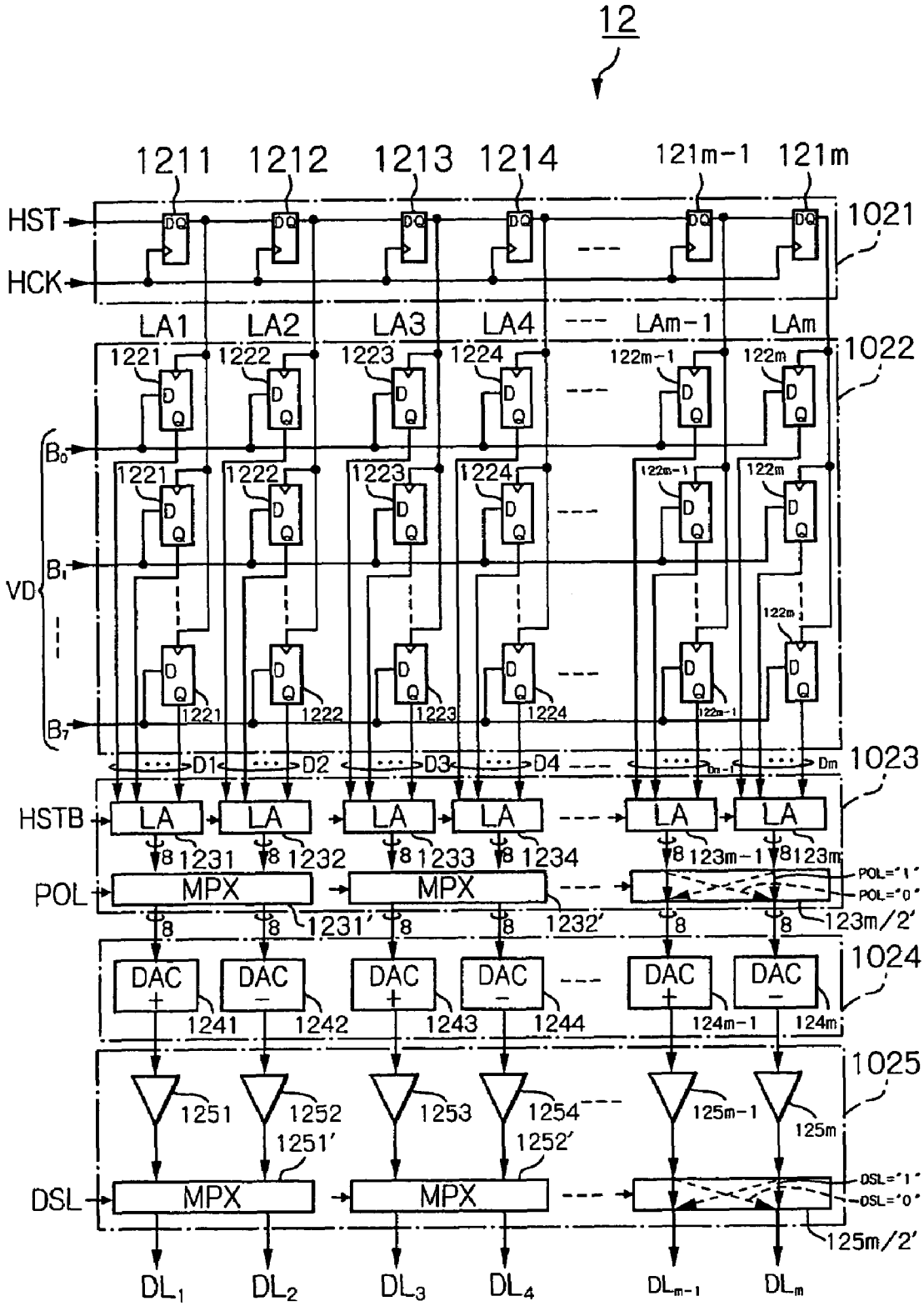
Fig. 2 PRIOR ART
FIG. 2 is a detailed circuit diagram of the data line driver circuit of FIG. 1.

In FIG. 2, which illustrates a detailed circuit diagram of the data line driver circuit 12 of FIG. 1, the data line driver circuit 12 is constructed by a shift register circuit 121, a data register circuit 122, a data latch circuit 123, a digital/analog (D/A) conversion circuit 124, and an output buffer circuit 125.

Figure 3:
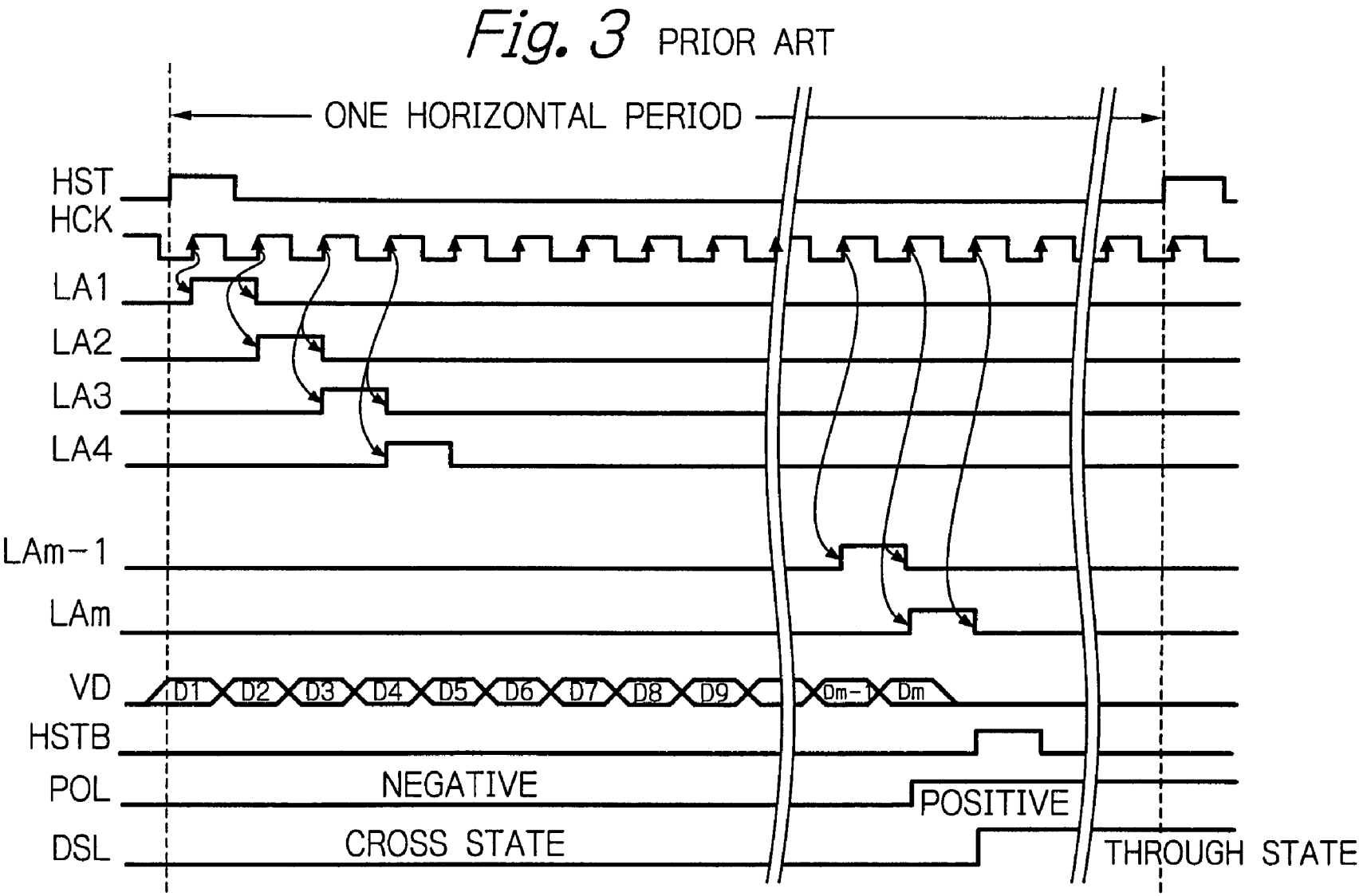
Fig. 3 PRIOR ART
FIG. 3 is a timing diagram for explaining the operation of the data line driver circuit of FIG. 2.

The shift register circuit 121 shifts a horizontal start pulse signal (HST) as shown in FIG. 3 in synchronization with a horizontal clock signal HCK as shown in FIG. 3. The shift register circuit 121 is formed by serially-connected D-type flip-flops 1211, 1212, 1213, 1214, . . . , 121*m*−1, 121*m* clocked by rising edges of the horizontal clock signal HCK to generate latch signals LA1, LA2, LA3, LA4, , LAm−1, LAm, sequentially, as shown in FIG. 3. Note that the horizontal start pulse signal HST is generated from a horizontal timing generating circuit (not shown) which receives a horizontal synchronization signal HSYNC. Also, the horizontal clock signal HCK is generated from a clock signal generating circuit (not shown).

Figure 8:
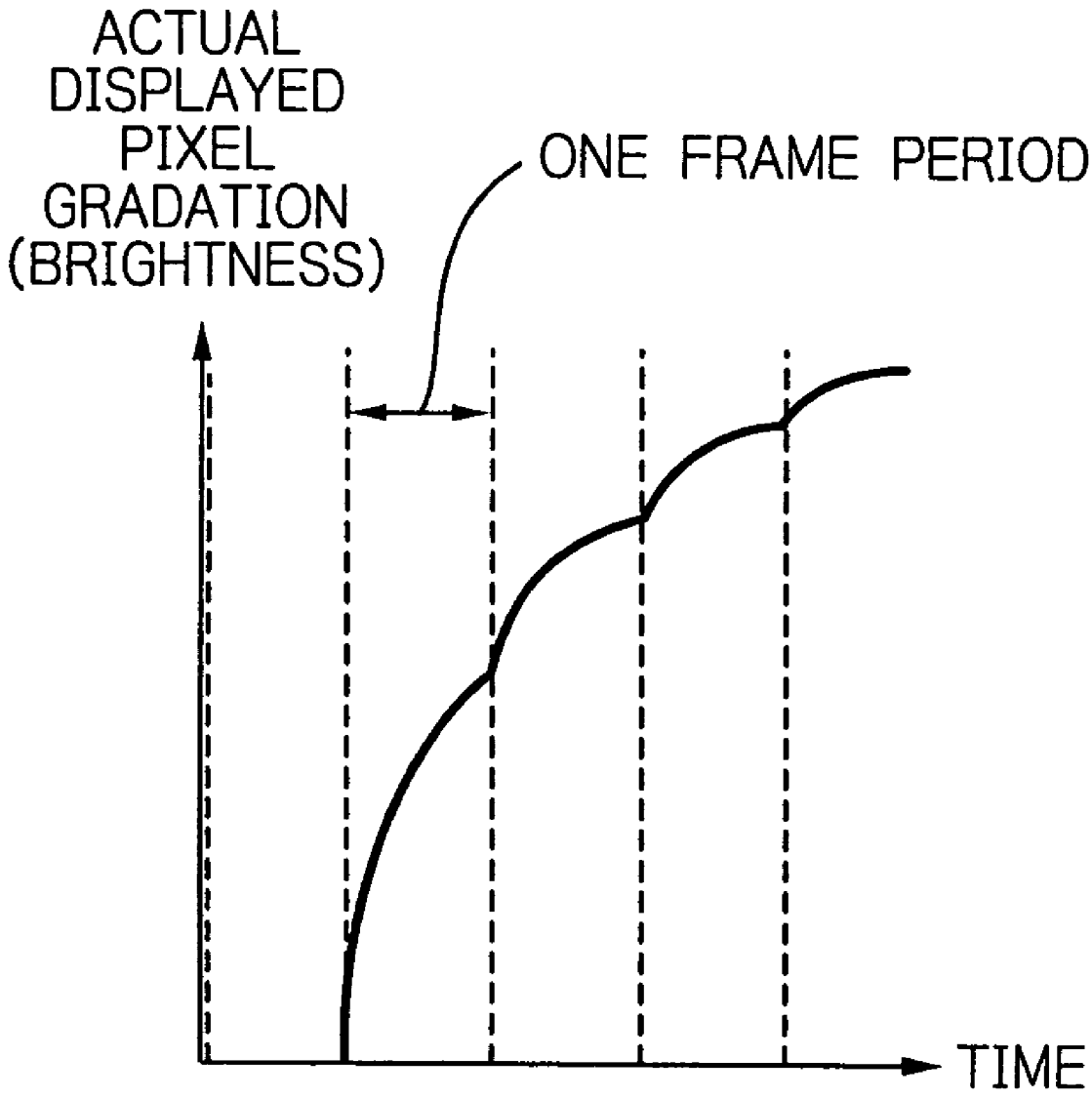
Fig. 8 PRIOR ART
FIG. 8 is a timing diagram for explaining a cause of the residual image phenomenon in the LCD apparatus of FIG. 1.

The data register circuit 122 latches an 8-bit gradation video data signal VD represented by $B_0$, $B_1$, . . . , $B_7$ in accordance with the latch signals LA1, LA2, LA3, LA4, . . . , LAm−1, LAm. The data register circuit 122 is formed by 8 D-type flip-flops 1221 clocked by the latch signal LA1 to latch digital video data D1 of the gradation video signal VD as shown in FIG. 3, 8 D-type flip-flops 1222 clocked by the latch signal LA2 to latch digital video data D2 of the gradation video signal VD as shown in FIG. 3, 8 D-type flip-flops 1223 clocked by the latch signal LA3 to latch digital video data D3 of the gradation video signal VD as shown in FIG. 3, 8 D-type flip-flops 1224 clocked by the latch signal LA4 to latch digital video data D4 of the gradation video signal VD as shown in FIG. 3, 8 D-type flip-flops 122*m*−1clocked by the latch signal LAm−1to latch digital video data Dm−1of the gradation video signal VD as shown in FIG. 3, and 8 D-type flip-flops 122*m* clocked by the latch signal LAm to latch digital video data Dm of the gradation video signal VD as shown in FIG. 3. In this case, the digital video data D1, D2, D3, D4, . . . , Dm−1, Dm of the 8-bit gradation video signal VD are sequentially generated from a signal processing circuit (not shown).

The data latch circuit 123 latches and multiplexes the digital video data D1, D2, D3, D4, . . . , Dm−1, Dm. The data latch circuit 123 is formed by latch circuits 1231, 1232, 1233, 1234, , 123*m*−1, 123*m* clocked by a horizontal strobe signal HSTB as shown in FIG. 3 which is generated from the horizontal timing generating circuit, and multiplexers 1231', 1232', . . . , 123*m*/2' clocked by a polarity signal POL as shown in FIG. 3 which is also generated from the horizontal timing generating circuit. This polarity signal POL is used for carrying out a dot inversion method which is advantageous in power consumption.

The D/A conversion circuit 124 is formed by positive-side D/A converters 1241, 1243, . . . , 124*m*−1 for generating analog gradation voltages on the positive side with respect to the common voltage VCOM and negative-side D/A converters 1242, 1244, . . . , 124*m* for generating analog gradation voltages on the negative side with respect to the common voltage VCOM. That is, if POL="1", the latch circuits 1231, 1232, 1233, 1234, , 123*m*−1, 123*m* are connected by the multiplexers 1231', 1232', . . . , 123*m*/2' to the D/A converters 1241, 1242, 1243, 1244, . . . , 124*m*−1, 124*m*, respectively. As a result, the D/A converters 1241, 1242, 1243, 1244, . . . , 124*m*−1, 124*m* generate analog video signals corresponding to the digital video signals D1, D2, D3, D4, . . . , Dm−1, Dm, respectively. On the other hand, if POL="0", the latch circuits 1231, 1232, 1233, 1234, . . . , 123*m*−1, 123*m* are connected by the multiplexers 1231', 1232', . . . , 123*m*/2' to the D/A converters 1242, 1241, 1244, 1243, . . . , 124*m*, 124*m*−1, respectively. As a result, the D/A converters 1241, 1242, 1243, 1244, . . . , 124*m*−1, 124*m* generate analog video signals corresponding to the digital video signals D2, D1, D4, D3, . . . , Dm, Dm−1, respectively.

The output buffer circuit 125 multiplexes the analog video signals from the D/A conversion circuit 124 in accordance with a data selection signal DSL as shown in FIG. 3 similar to the polarity signal POL. The data selection signal DSL is generated from the horizontal timing generating circuit. The output buffer circuit 125 is formed by amplifiers (usually, voltage-follower-type operational amplifiers) 1251, 1252, 1253, 1254, . . . , 125*m*−1, 125*m* for amplifying the analog video signals from the D/A converters 1241, 1242, 1243, 1244, . . . , 124*m*−1, 124*m*, respectively, and multiplexers

1251', 1252', . . . , 125*m*/2' clocked by the data selection signal DOL. In this case, the multiplexers 1251', 1252', . . . , 125*m*/2' operate in the same way as the multiplexers 1231', 1232', . . . , 123*m*/2', respectively, of the data latch circuit 123. That is, if DSL="1", the multiplexers 1251', 1252', . . . , 125*m*/2' are in a through state, while if DSL="0", the multiplexers 1251', 1252', . . . , 125*m*/2' are in a cross state. Therefore, the analog video signals corresponding to the digital video signals D1, D2, D3, D4, . . . , Dm−1, Dm are supplied to the data lines $DL_1$, $DL_2$, $DL_3$, $DL_4$, . . . , $DL_{m-1}$, $DL_m$, respectively. Note that the analog video signals corresponding to the digital video signals D2, D1, D4, D3, . . . , Dm, Dm−1 are never supplied to the respective data lines $DL_1$, $DL_2$, $DL_3$, $DL_4$, . . . , $DL_{m-1}$, $DL_m$.

Figure 4:
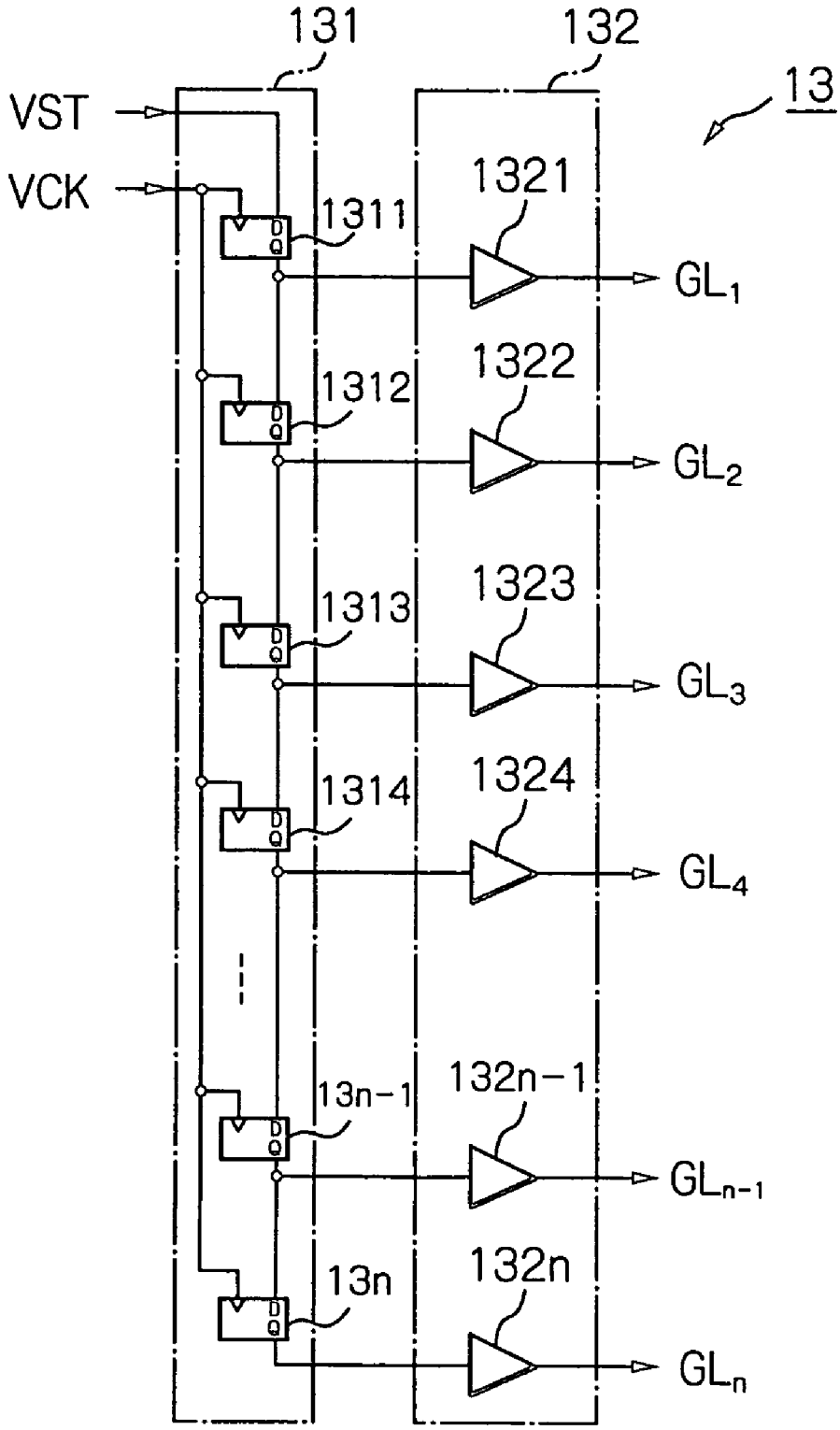
Fig. 4 PRIOR ART
FIG. 4 is a detailed circuit diagram of the gate line driver circuit of FIG. 1.
Figure 5:
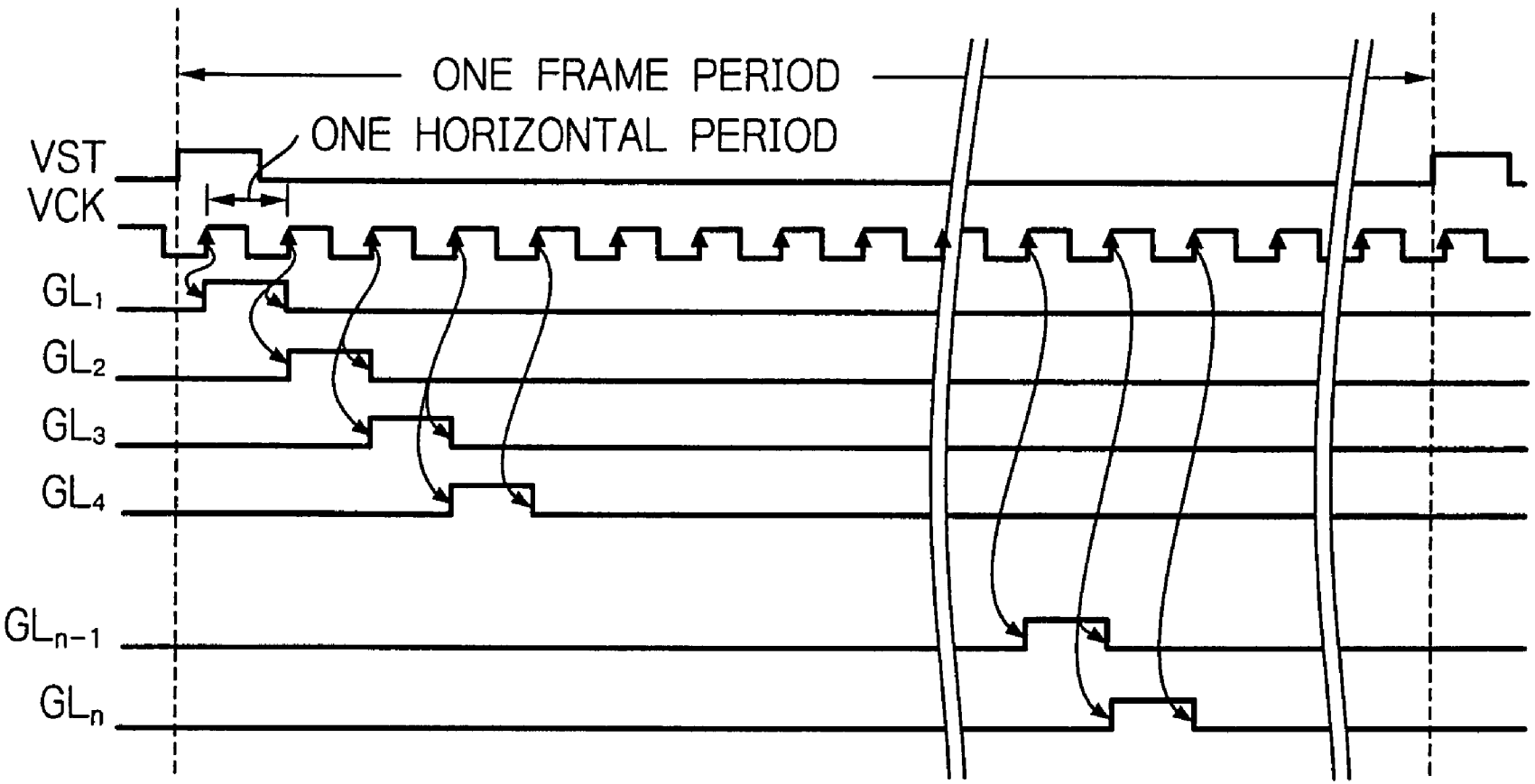
Fig. 5 PRIOR ART
FIG. 5 is a timing diagram for explaining the operation of the gate line driver circuit of FIG. 4.

In FIG. 4, which illustrates a detailed circuit diagram of the gate line driver circuit 13 of FIG. 1, the gate line driver circuit 13 is constructed by a shift register circuit 131 for shifting a vertical start pulse signal VST as shown in FIG. 5 in synchronization with a vertical clock signal VCK as shown in FIG. 5, and an output buffer circuit 132 formed by amplifiers (usually, voltage-follower-type operational amplifiers) 1321, 1322, 1323, 1324, . . . , 132*n*−1, 132*n*. Note that one vertical start pulse signal VST is generated per one frame period. This shift register circuit 131 is formed by serially-connected D-type flip-flops 1311, 1312, 1313, 1314, . . . , 131*n*−1, 131*n* clocked by rising edges of the vertical clock signal VCK to generate gate line signals (or scan line signals) as shown in FIG. 5 on the gate lines $GL_1$, $GL_2$, $GL_3$, $GL_4$, . . . , $GL_{n-1}$, $GL_n$, respectively.

Figure 6:
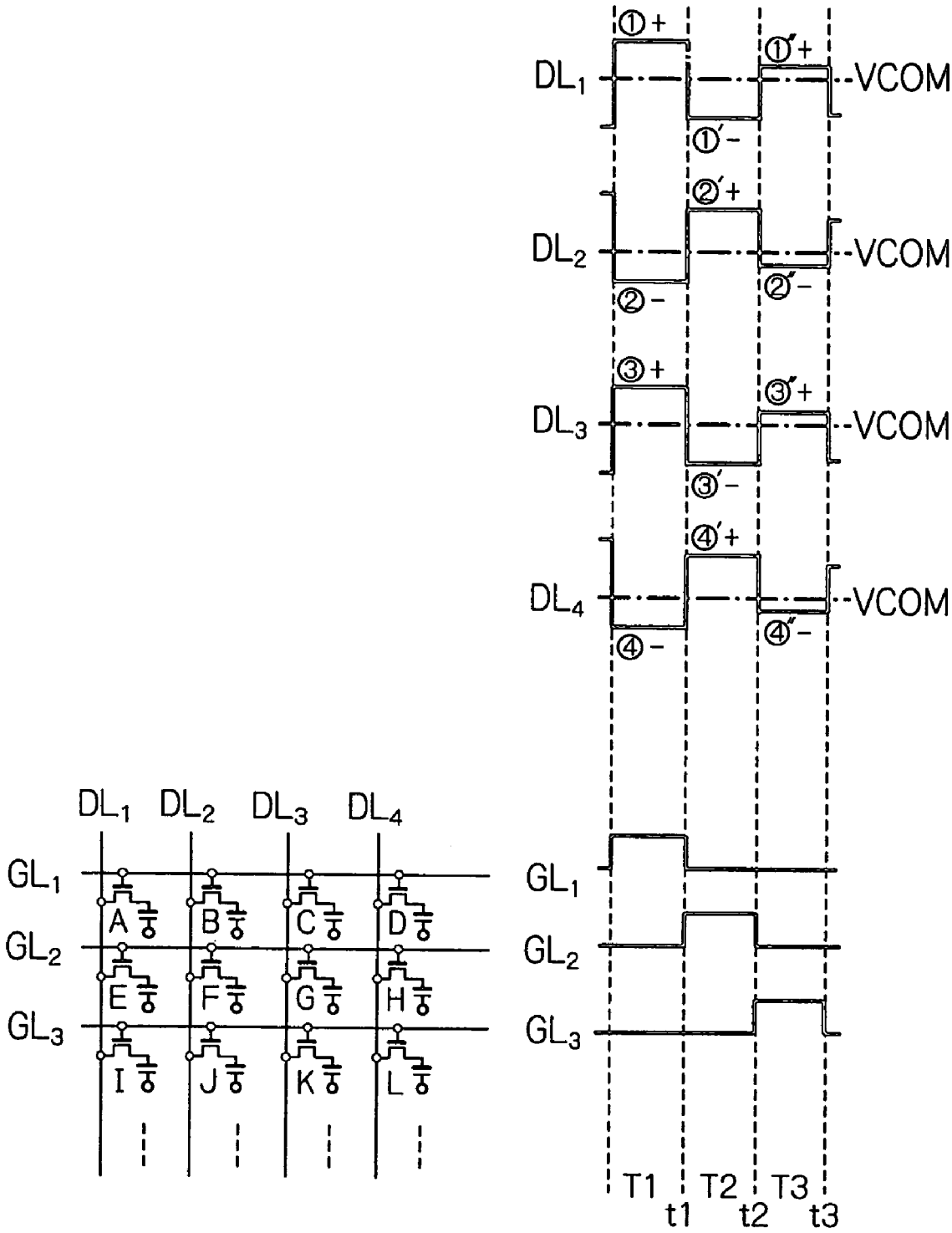
Fig. 6 PRIOR ART
FIG. 6 is a timing diagram for explaining the operation of the LCD apparatus of FIG. 1.
Figure 7:
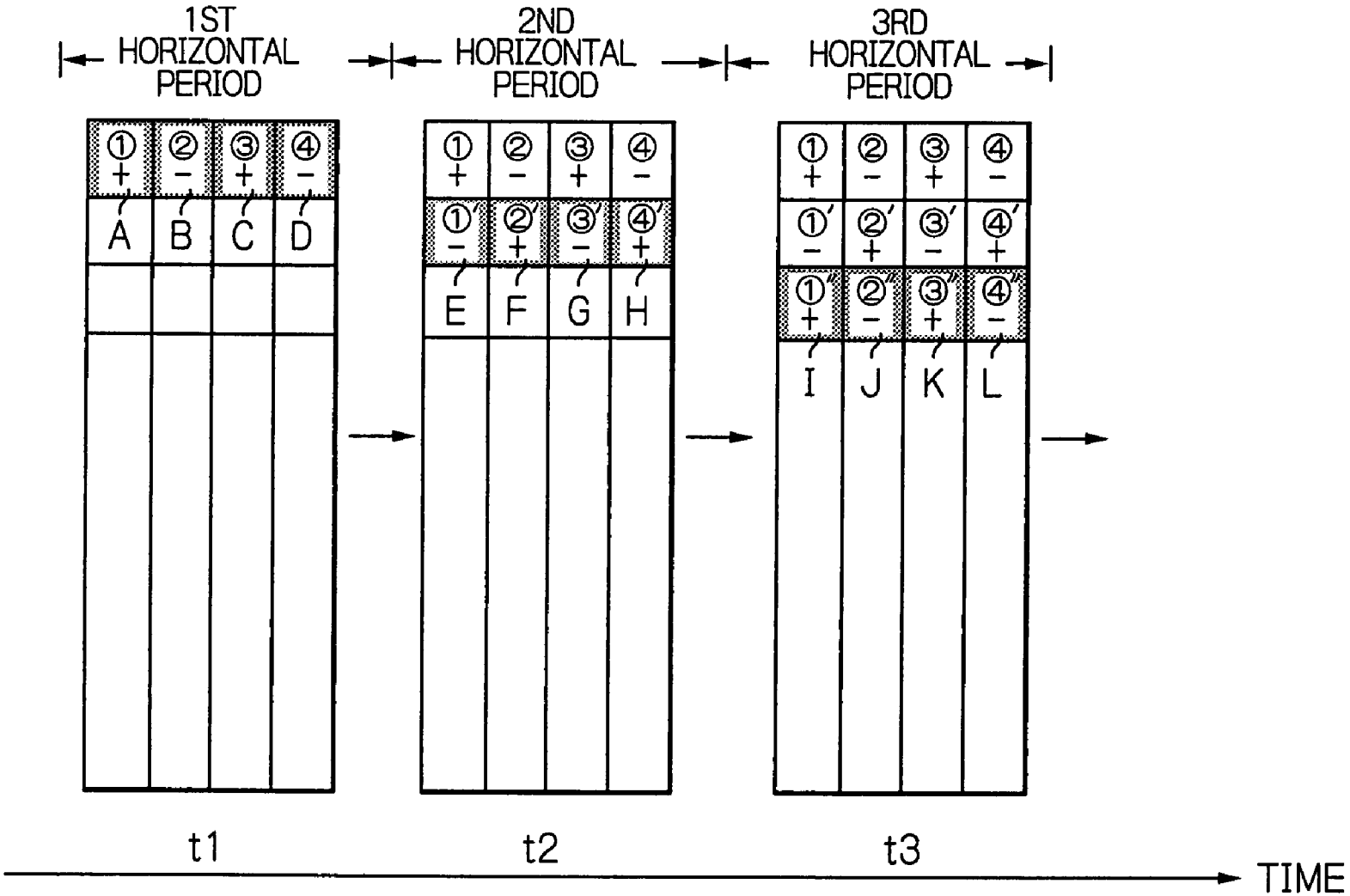
Fig. 7 PRIOR ART
FIG. 7 is a timing diagram for supplementally explaining the operation of FIG. 6.

As illustrated in FIG. 6, in a first frame period T1, when video data ①+, ②−, ③+ and ④− are supplied to the data lines $DL_1$, $DL_2$, $DL_3$ and $DL_4$, respectively, while the gate line signal at the gate line $GL_1$ is high, the video data ①+, ②−, ③+ and ④− are written into pixels A, B, C and D, respectively, at time t1 as illustrated in FIG. 7.

Next, in a second frame period T2, when video data ①'−, ②'+, ③'− and ④'+ are supplied to the data lines $DL_1$, $DL_2$, $DL_3$ and $DL_4$, respectively, while the gate line signal at the gate line $GL_2$ is high, the video data ①'−, ②'+, ③'− and ④'+ are written into pixels E, F, G and H, respectively, at time t2 as illustrated in FIG. 7.

Next, in a third frame period T3, when video data ①"+, ②"−, ③"+ and ④"− are supplied to the data lines $DL_1$, $DL_2$, $DL_3$ and $DL_4$, respectively, while the gate line signal at the gate line $GL_3$ is high, the video data ①"+, ②"−, ③"+ and ④"− are written into pixels I, J, K and L, respectively, at time t3 as illustrated in FIG. 7.

Thereafter, similar operations follow.

Figure 9A:
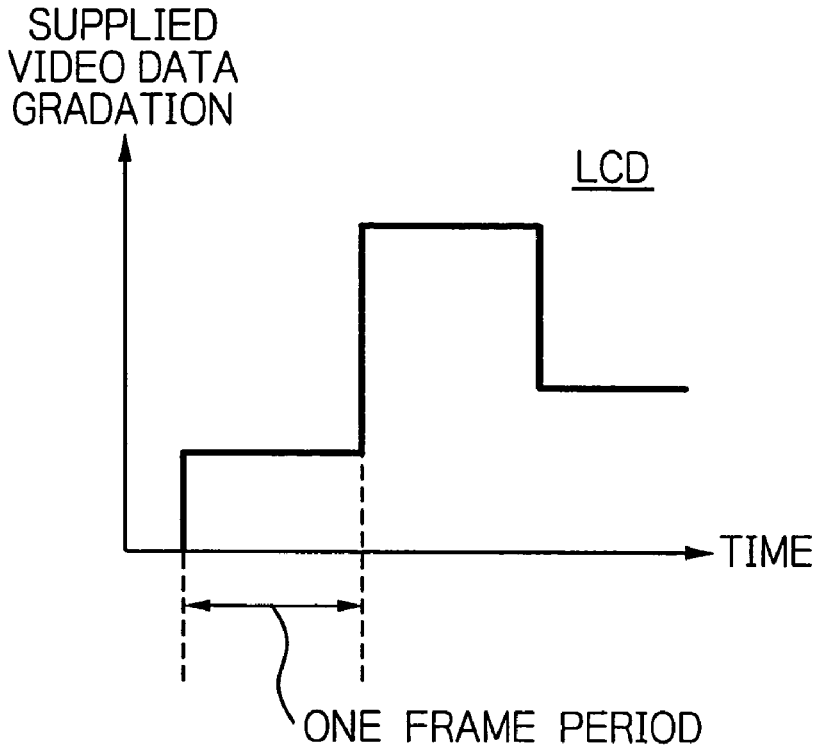
Fig. 9A PRIOR ART
FIGS. 9A and 9B are timing diagrams for explaining another cause of the residual image phenomenon in the LCD apparatus of FIG. 1.
Figure 9B:
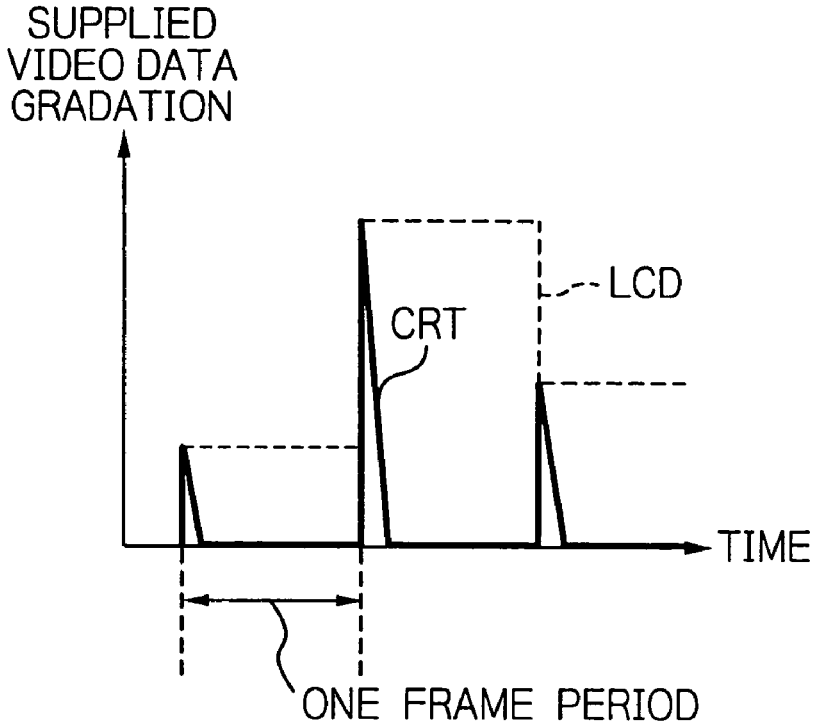
Fig. 9B PRIOR ART

In the LCD apparatus of FIG. 1, however, the quality of display deteriorates due to the residual image phenomenon. For example, if the LCD apparatus of FIG. 1 is of a twisted nematic (TN) type, the response speed is on the order of 10 ms which is longer than one frame period such as 1/60 sec. As a result, as illustrated in FIG. 8, the application of a displayed pixel gradation voltage (brightness) actually cannot follow the writing of its corresponding video data to one of the data lines $DL_1$, $DL_2$, $DL_3$, $DL_4$, . . . , $DL_{m-1}$, $DL_m$. For example, it will take three or four frame periods for the actual displayed pixel gradation voltage to reach its target voltage represented by the corresponding video data. Thus, the above-mentioned residual image phenomenon is caused by the low response speed of the LCD apparatus of FIG. 1. Additionally, the above-mentioned residual image phenomenon is caused, since the LCD apparatus of FIG. 1 is of a hold type (see: Taiichiro Kurita, "Degradation of Quality of Moving Images Displayed on Hold Type Displays and Its Improving Method", 1999 Symposium of IEICE, SC-8-1, pp. 207-208, 1999). That is, as illustrated in FIG. 9A, in a hold type display apparatus such as the LCD apparatus of FIG. 1, since a supplied video data gradation holds for one frame period, the supplied video data remains until the next video data is supplied, which would enhance the residual image phenomenon. On the other hand, as illustrated in FIG. 9B, in an impulse type display apparatus such as a cathode ray tube (CRT) display apparatus, a supplied video data gradation holds only for a short time such as several milliseconds, which would suppress the residual image phenomenon.

Figure 10:
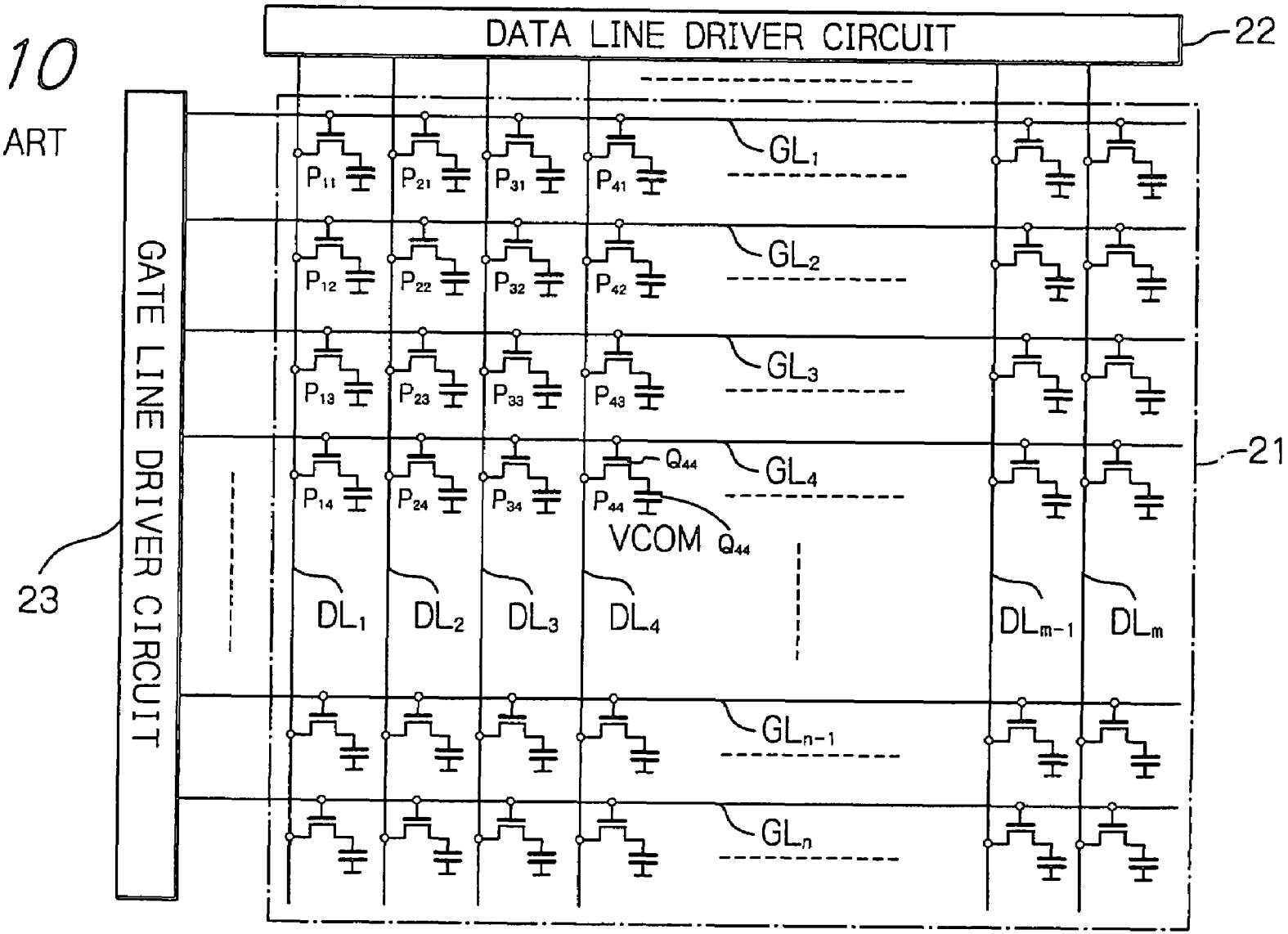
Fig. 10 PRIOR ART
FIG. 10 is a block circuit diagram illustrating a second prior art LCD apparatus.

In FIG. 10, which illustrates a second prior art LCD apparatus (see: JP-A-2000-122596), in order to suppress the residual image phenomenon, while video data are supplied to pixels on one gate line, black signals are supplied to pixels on another gate line.

In FIG. 10, an LCD panel 21, a data line driver circuit 22 and a gate line driver circuit 23 are provided. In this case, the LCD panel 21 and the data line driver circuit 22 have the same configuration as the LCD panel 11 and the data line driver circuit 12, respectively, of FIG. 1.

Figure 11:
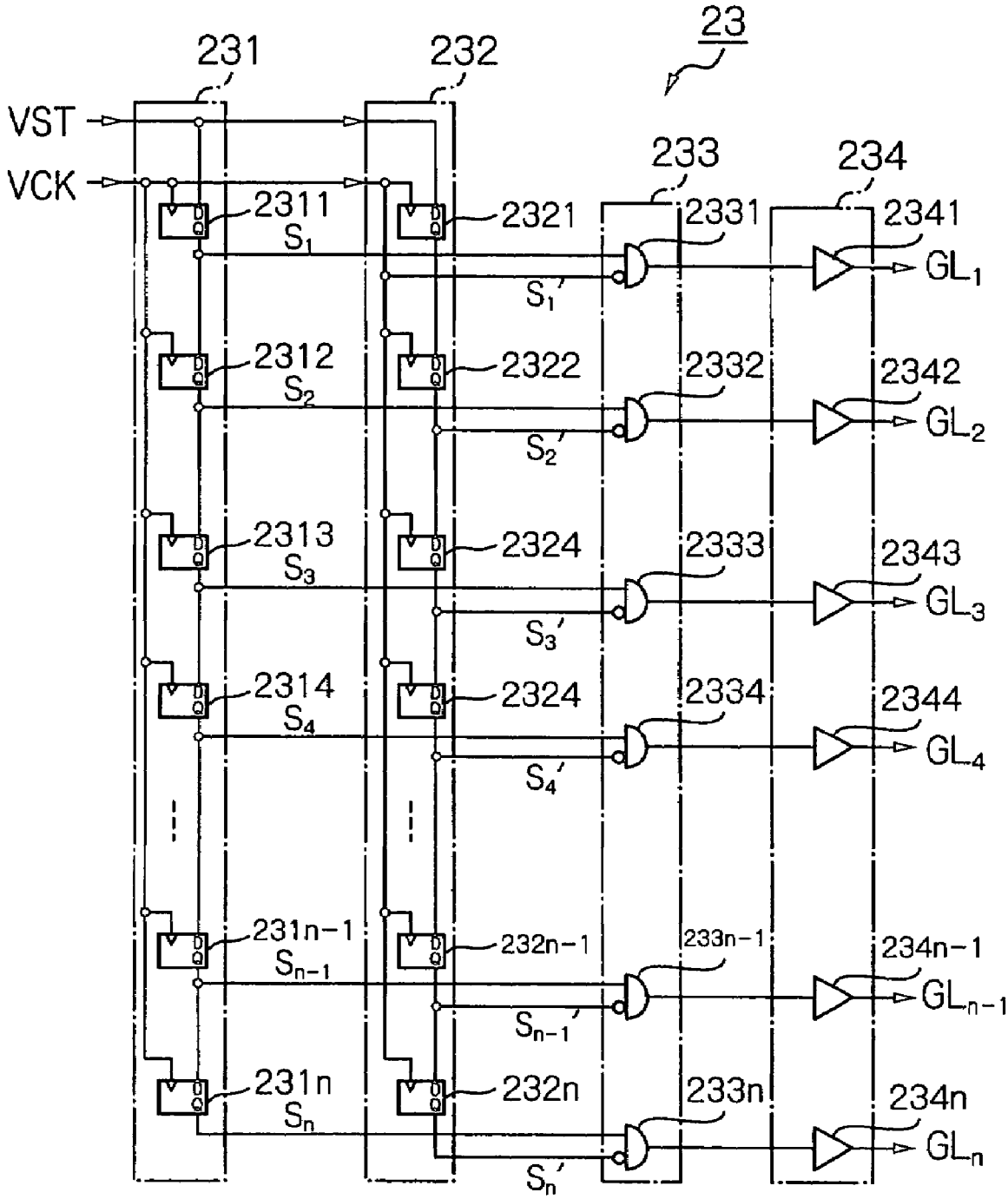
Fig. 11 PRIOR ART
FIG. 11 is a detailed circuit diagram of the gate line driver circuit of FIG. 10.
Figure 12:
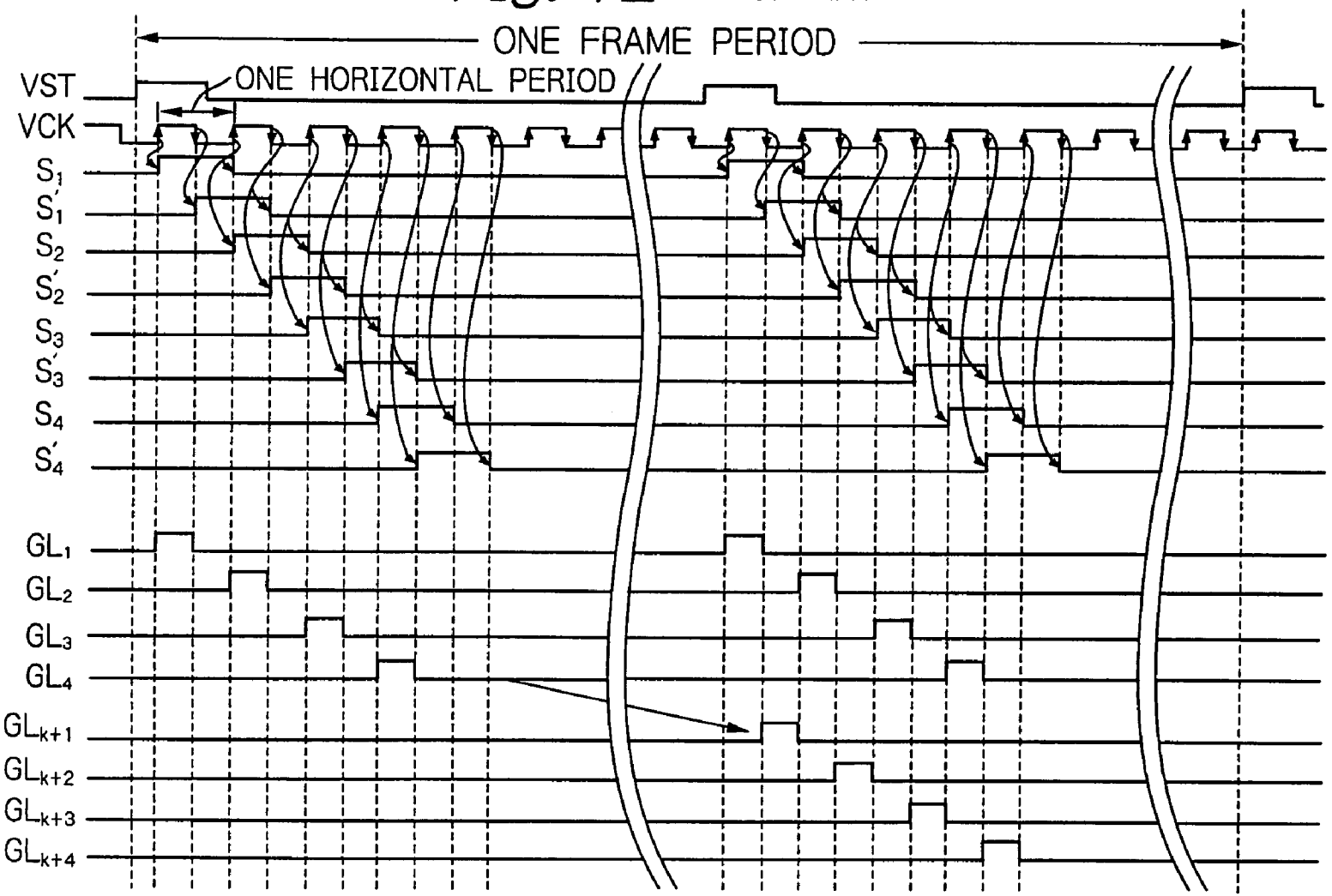
Fig. 12 PRIOR ART
FIG. 12 is a timing diagram for explaining the operation of the gate line driver circuit of FIG. 11.

In FIG. 11, which illustrates a detailed circuit diagram of the gate line driver circuit 23 of FIG. 10, the gate line driver circuit 23 is constructed by shift register circuits 231 and 232 for shifting a vertical start pulse signal VST as shown in FIG. 12 in synchronization with a vertical clock signal VCK as shown in FIG. 12, a gate circuit 233, and an output buffer circuit 234 formed by amplifiers (usually, voltage-follower-type operational amplifiers) 2341, 2342, 2343, 2344, . . . , 234*n*−1, 234*n*.

The shift register circuit 231 is formed by serially-connected D-type flip-flops 2311, 2312, 2313, 2314, . . . , 231*n*−1, 231*n* clocked by rising edges of the vertical clock signal VCK to generate signals $S_1$, $S_2$, $S_3$, $S_4$, . . . , $S_{n-1}$, $S_n$ as shown in FIG. 12.

The shift register circuit 232 is formed by serially-connected D-type flip-flops 2321, 2322, 2323, 2324, . . . , 232*n*−1, 232*n* clocked by falling edges of the vertical clock signal VCK to generate signals $S_1'$, $S_2'$, $S_3'$, $S_4'$, . . . , $S_{n-1}'$, $S_n'$ as shown in FIG. 12.

The gate circuit 233 is formed by a gate 2331 for receiving the signals $S_1$ and $S_1'$, a gate 2332 for receiving the signals $S_2$ and $S_2'$, a gate 2333 for receiving the signals $S_3$ and $S_3'$, a gate 2334 for receiving the signals $S_4$ and $S_4''$, . . . , a gate 233*n*−1 for receiving the signals $S_{n-1}$, and $S_{n-1}'$, a gate 233*n* for receiving the signals $S_n$ and $S_n'$, to generate gate line signals (or scan line signals) on the gate lines $GL_1$, $GL_2$, $GL_3$, $GL_4$, . . . , $GL_{n-1}$, $GL_n$, respectively, as shown in FIG. 12.

In FIG. 12, two vertical start pulse signals VST are generated per one frame period. A first one of the vertical start pulse signals VST is used for writing black data, while a second one of the vertical start pulse signals VST is used for writing video data.

Figure 13:
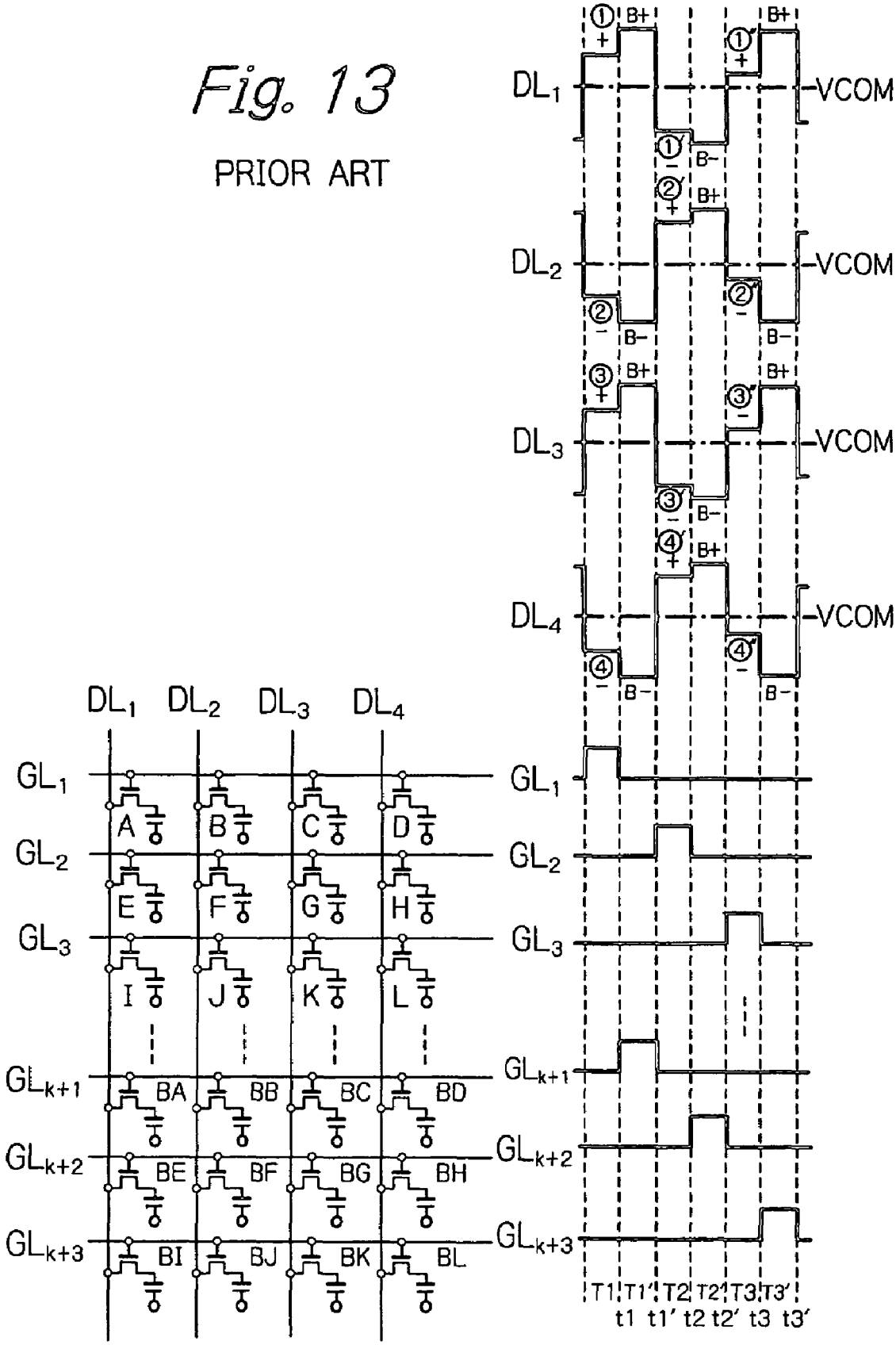
Fig. 13 PRIOR ART
FIG. 13 is a timing diagram for explaining the operation of the LCD apparatus of FIG. 10.
Figure 14:
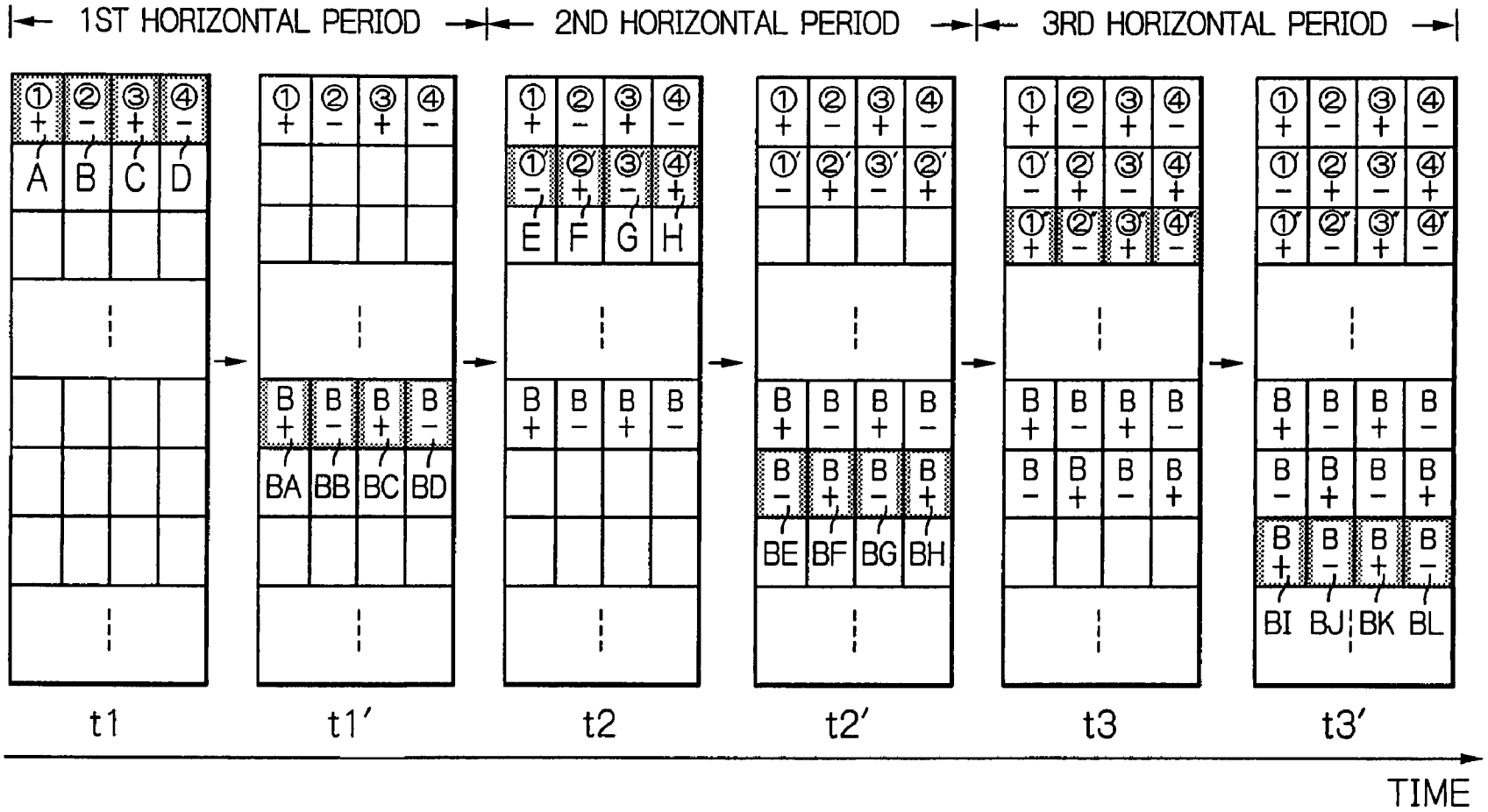
Fig. 14 PRIOR ART
FIG. 14 is a timing diagram for supplementally explaining the operation of FIG. 13.

As illustrated in FIG. 13, in the former half T1 of a first frame period, when video data ①+, ②−, ③+ and ④− are supplied to the data lines $DL_1$, $DL_2$, $DL_3$ and $DL_4$, respectively, while the gate line signal at the gate line $GL_1$ is high, the video data ①+, ②−, ③+ and ④− are written into pixels A, B, C and D, respectively, at time t1 as illustrated in FIG. 14. Subsequently, as illustrated in FIG. 13, in the latter half T1' of the first frame period, when black data B+, B−, B+and B− are supplied to the data lines $DL_{K+1}$, $DL_{K+2}$, $DL_{K+3}$ and $DL_{K+4}$, respectively, while the gate line signal at the gate line $GL_{K+1}$ is high, the black data B+, B−, B+ and B− are written into pixels BA, BB, BC and BD, respectively, at time t1' as illustrated in FIG. 14.

Next, in the former half T2 of a second frame period, when video data ①'−, ②'+, ③'− and ④'+ are supplied to the data lines $DL_1$, $DL_2$, $DL_3$ and $DL_4$, respectively, while the gate line signal at the gate line $GL_2$ is high, the video data ①'−, ②'+, ③'− and ④'+ are written into pixels E, F, G and H, respectively, at time t2 as illustrated in FIG. 14. Subsequently, in the latter half T2' of the second frame period, when black data B−, B+, B− and B+ are supplied to the data lines $DL_1$, $DL_2$, $DL_3$ and $DL_4$, respectively, while the gate line signal at the gate line $GL_{k+2}$ is high, the black data B−, B+, B− and B+ are written into pixels BE, BF, BG and BH, respectively, at time t2 as illustrated in FIG. 14.

Next, in the former half T3 of a third frame period, when video data ①"+, ②"−, ③"+ and ④"− are supplied to the data lines $DL_1$, $DL_2$, $DL_3$ and $DL_4$, respectively, while the gate line signal at the gate line $GL_3$ is high, the video data ①"+, ②"−, ③"+ and ④"− are written into pixels I, J, K and L, respectively, at time t3 as illustrated in FIG. 14. Subsequently, in the latter half T3' of the third frame period, when video data B+, B−, B+ and B− and supplied to the data lines $DL_1$, $DL_2$, $DL_3$ and $DL_4$, respectively, while the gate line signal at the gate line $GL_{k+3}$ is high, the video data B+, B−, B+ and B− are written into pixels BI, BJ, BK and BL, respectively, at time t3' as illustrated in FIG. 14.

Thereafter, the same operation as described above is repeated.

Figure 15:
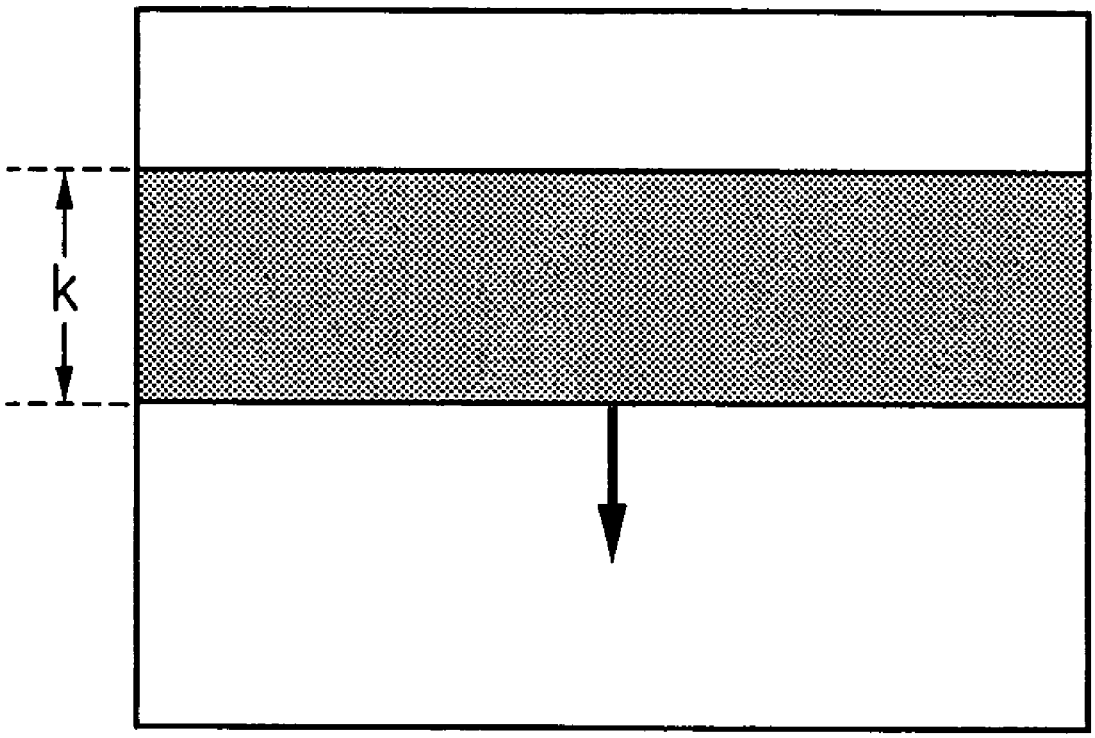
Fig. 15 PRIOR ART
FIG. 15 is a diagram illustrating a black region of the LCD panel of FIG. 10.

Thus, as illustrated in FIG. 15, a black region having a width of k gate lines where k=1, 2, 3, . . . is scanned on a screen to suppress the residual image phenomenon.

In the LCD apparatus of FIG. 10, however, since the data line driver circuit 22 has the same configuration as the data driver circuit 12 of FIG. 2, the data line driver circuit 22 is still large in scale, preventing the LCD apparatus from being compact in size. Also, since the output buffer circuit of the data driver circuit 22 has the same number of power consuming amplifiers (voltage followers) as the data lines $DL_1$, $DL_2$, . . . , $DL_m$, the power consumption is enormously increased.

Figure 16:
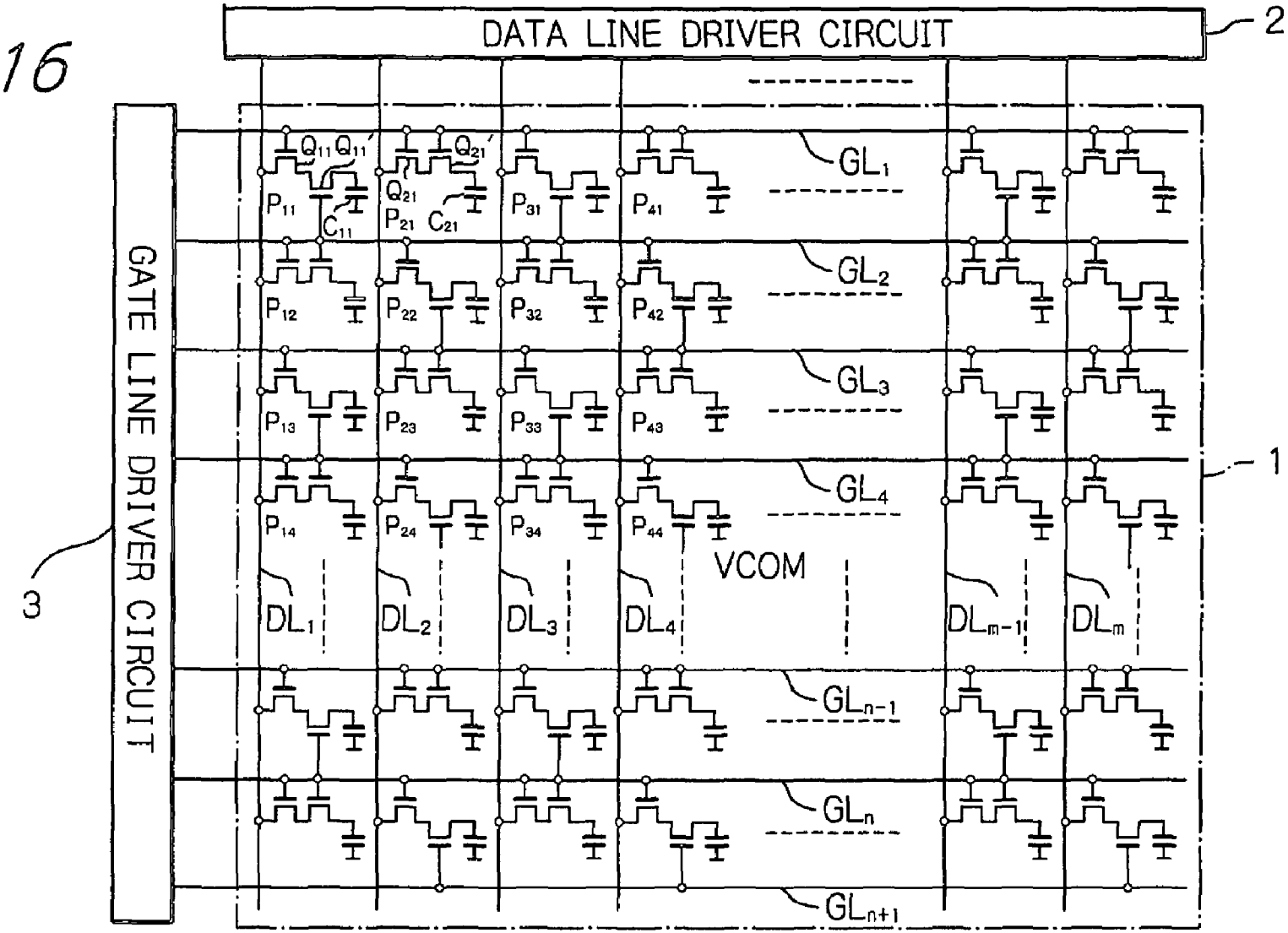
FIG. 16 is a block circuit diagram illustrating a first embodiment of the LCD apparatus according to the present invention.

In FIG. 16, which illustrates a first embodiment of the LCD apparatus according to the present invention, reference numeral 1 designates an LCD panel having m×n dots where m is 640 and n is 480, for example. That is, the LCD panel 1 includes m data lines $DL_1$, $DL_2$, $DL_3$, $DL_4$, . . . , $DL_{m-1}$, $DL_m$ driven by a data line driver circuit 2, (n+1) gate lines $GL_1$, $GL_2$, $GL_3$, $GL_4$, . . . , $GL_{n-1}$, $GL_n$, $GL_{n+1}$, and m×n pixels $P_{ij}$ located at intersections between the data lines $DL_1$, $DL_2$, $DL_3$, $DL_4$, . . . , $DL_{n-1}$, $DL_n$ and the gate lines $GL_1$, $GL_2$, $GL_3$, $GL_4$, . . . , $GL_{n-1}$, $GL_n$, $GL_{n+1}$, The gate line $GL_{n+1}$ is additional to the gate lines $GL_1$, $GL_2$, $GL_3$, $GL_4$, . . . , $GL_{n-1}$, $GL_n$ of FIGS. 1 and 10; however, this would never increase the manufacturing steps.

Each of the pixels $P_{ij}$ is constructed by two TFTs $Q_{ij}$ and $Q_{ij}'$ and one pixel capacitor $C_{ij}$ including liquid crystal connected to a common electrode to which the common electrode voltage VCOM is applied. The TFT $Q_{ij}$ is connected between the data line $DL_i$ and the TFT $Q_{ij}'$, and the TFT $Q_{ij}'$ is connected between the TFT $Q_{ij}$ and the pixel capacitor $C_{ij}$.

If i+j=2, 4, 6, . . . , the pixel $P_{ij}$ is of a first type where the gate of the TFT $Q_{ij}$ such as $Q_{11}$ is connected to the gate line $GL_j$ such as $GL_1$ and the gate of the TFT $Q_{ij}'$ such as $Q_{11}'$ is connected to the gate line $GL_{j+1}$ such as $GL_2$. Therefore, when the voltages at the gate lines $GL_j$ and $GL_{j+1}$ are both high, video data or black data is supplied from the data line $DL_i$ to the first type pixel $P_{ij}$ (i+j=2, 4, 6, 8, . . . ).

On the other hand, if i+j=3, 5, 7, 9, . . . , the pixel $P_{ij}$ is of a second type where the gates of the TFT $Q_{ij}$ and $Q_{ij}'$ such as $Q_{21}$ and $Q_{21}'$ are both connected to the gate line $GL_j$ such as $GL_1$. Therefore, when the voltage at the gate line $GL_j$ is high, video data or black data is supplied from the data line $DL_i$ to the second type pixel $P_{ij}$ (i+j=3, 5, 7, 9, . . . ).

The first type pixels $P_{ij}$ (i+j=2, 4, 6, 8, . . . ) and the second type pixels $P_{ij}$ (i+j=3, 5, 7, 9, . . . ) are staggered in the LCD panel 1. That is, the first type pixels $P_{ij}$ (i+j=2, 4, 6, 8, . . . ) and the second type pixels $P_{ij}$ (i+j=3, 5, 7, 9, . . . ) are alternately arranged in rows, columns.

Figure 17:
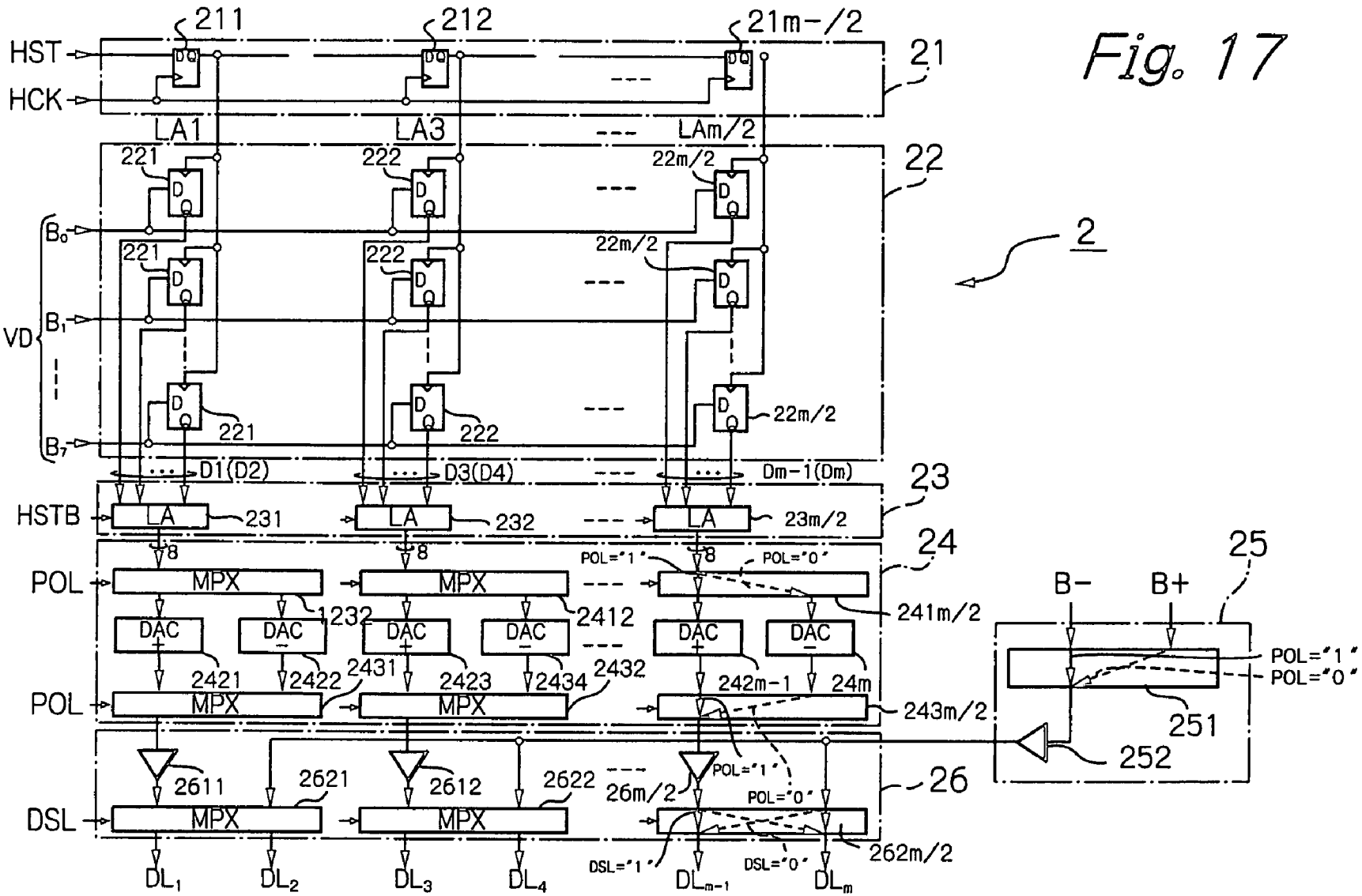
FIG. 17 is a detailed circuit diagram of the data line driver circuit of FIG. 16.

In FIG. 17, which illustrates a detailed circuit diagram of the data line driver circuit 2 of FIG. 16, the data line driver circuit 2 is constructed by a shift register circuit 21, a data register circuit 22, a data latch circuit 23, a digital/analog conversion circuit 24, a black data voltage generation circuit 25, and an output buffer circuit 26.

Figure 18:
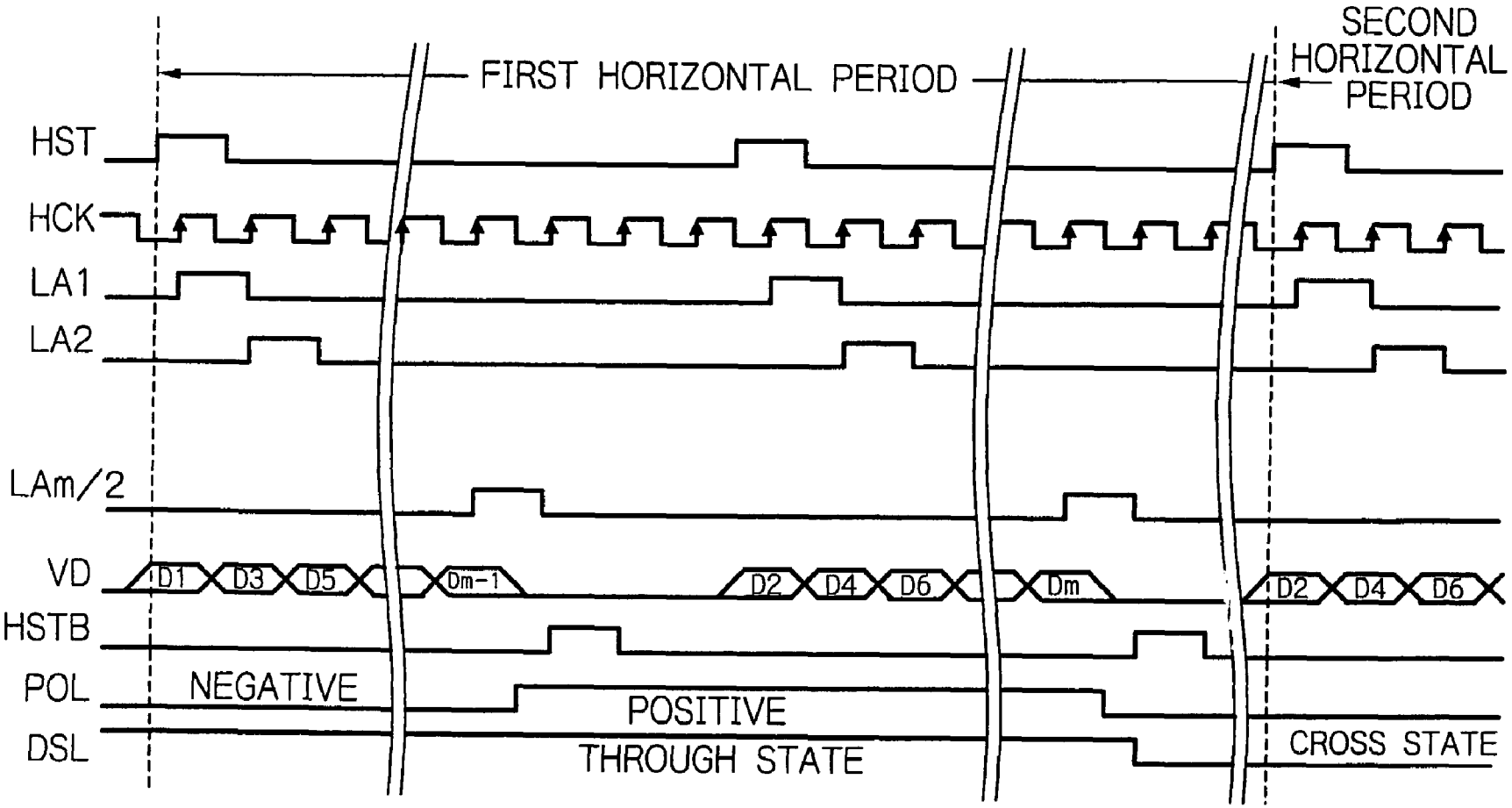
FIG. 18 is a timing diagram for explaining the operation of the data line driver circuit of FIG. 17.

The shift register circuit 21 shifts a horizontal start pulse signal HST as shown in FIG. 18 in synchronization with a horizontal clock signal HCK as shown in FIG. 18. The shift register circuit 21 is formed by serially-connected D-type flip-flops 211, 212, . . . , 21*m*/2 clocked by rising edges of the horizontal clock signal HCK to generate latch signals LA1, LA2, . . . , LAm/2, sequentially as shown in FIG. 18. Note that two horizontal start pulse signals HST are generated per one horizontal synchronization signal HSYNC from a horizontal timing generating circuit (not shown) which receives the horizontal synchronization signal HSYNC. Also, the horizontal clock signal HCK is generated from a clock signal generating circuit (not shown).

The data register circuit 22 latches an 8-bit gradation video data signal VD represented by $B_0$, $B_1$, . . . , $B_7$ in accordance with the latch signals LA1, LA2, . . . , LAm/2. The data register circuit 22 is formed by 8 D-type flip-flops 221 clocked by the latch signal LA1 to latch digital video data D1 or D2 of the gradation video signal VD as shown in FIG. 18, 8 D-type flip-flops 222 clocked by the latch signal LA2 to latch digital video data D3 or D4 of the gradation video signal VD as shown in FIG. 18, . . . , 8 D-type flip-flops 22 clocked by the latch signal LA1*m*/2 to latch digital video data Dm−1 or Dm of the gradation video signal VD as shown FIG. 18. In this case, the digital video data D1, D3, . . . , Dm−1, D2, D4, . . . , Dm of the 8 bit gradation video signal VD are sequentially generated from a signal processing circuit (not shown). In more detail, in a first horizontal period, the digital video data D1, D3, . . . , Dm−1, D2, D4, . . . , Dm are sequentially generated, and in a second horizontal period alternately with the first horizontal period, the digital video data D2, D4, . . . , Dm, D1, D3, . . . , Dm−1 are sequentially generated.

The data latch circuit 23 latches the digital video data D1 or D2, D3 or D4, . . . , Dm−1 or Dm. The data latch circuit 23 is formed by latch circuits 231, 232, 23*m*/2 clocked by a horizontal strobe signal HSTB as shown in FIG. 18 which is generated from the horizontal timing generating circuit.

The D/A conversion circuit 24 is formed by multiplexers 2411, 2412, . . . , 241*m*/2 clocked by a polarity signal POL as shown in FIG. 18, positive-side D/A converters 2421, 2423, . . . , 242*m*−1 for generating analog gradation voltages on the positive side with respect to the common voltage VCOM, negative-side D/A converters 2422, 2424, 242*m* for generating analog gradation voltages on the negative side with respect to the common voltage VCOM, and multiplexers 2431, 2432, . . . , 243*m*/2 clocked by the polarity signal POL. That is, if POL="1", the positive-side D/A converters 2421, 2423, 242*m*−1 are selected by the multiplexers 2411, 2412, . . . , 241*m*/2 and the multiplexers 2431, 2432, . . . , 243*m*/2. As a result, the D/A conversion circuit 24 generates positive polarity analog video signals corresponding to the digital video signals D1 or D2, D3 or D4, . . . , Dm−1 or Dm, respectively, and transmits them to the output buffer circuit 26. On the other hand, if POL="0", the negative-side D/A converters 2422, 2424, 242*m* are selected by the multiplexers 2411, 2412, . . . , 241*m*/2 and the multiplexers 2431, 2432, . . . , 243*m*/2. As a result, the D/A conversion circuit 24 generates negative polarity analog video signals corresponding to the digital video signals D1 or D2, D3 or D4, . . . , Dm−1 or Dm, respectively, and transmits them to the output buffer circuit 26.

The black data voltage generation circuit 25 is formed by a multiplexer 251 clocked by the polarity signal POL and an amplifier 252. The multiplexer 251 operates in the same way as the multiplexers 2411, 2412, . . . , 241*m*/2 and the multiplexers 2431, 2432, . . . , 243*m*/2. That is, if POL="1", black data B− is selected, amplified and transmitted to the output buffer circuit 26. On the other hand, if POL="0", black data B+ is selected, amplified and transmitted to the output buffer circuit 26.

The output buffer circuit 26 multiplexes the analog video signals from the D/A conversion circuit 24 and the black data voltage B− or B+ in accordance with a data selection signal DSL which is nearly equal to a signal obtained by dividing the polarity signal POL. The data selection signal DSL is generated from the horizontal timing generating circuit.

The output buffer circuit 26 is formed by amplifiers (usually, voltage-follower-type operational amplifiers) 2611, 2612, . . . , 261*m*/2 for amplifying the analog video signals from the multiplexers 2431, 2432, . . . , 243*m*/2, respectively, of the D/A conversion circuit 24 and multiplexers 2621, 2622, . . . , 262*m*/2 clocked by the data selection signal DSL. In this case, if DSL="1", the multiplexers 2621, 2622, . . . , 262*m*/2 are in a through state, while, if DSL="0", the multiplexers 2621, 2622, . . . , 262*m*/2 are in a cross state.

Therefore, in a first horizontal period, when POL="1" (positive) and DSL="1" (through state), signals D1(+), B−, D3(+), B−, . . . , Dm−1(+), B− and generated from the output buffer circuit 26, and subsequently, when POL="0" (negative) and DSL="0" (cross state), signals B+, D2(−), B+, D4(−), . . . , B+, Dm(−) are generated from the output buffer circuit 26.

On the other hand, in a second horizontal period, when POL="1" (positive) and DSL="0" (cross state), signals B−, D2(+), B−, D4(+), . . . , B−, Dm(+) are generated from the output buffer circuit 26, and subsequently, when POL="0" (negative) and DSL="1" (through state), signals D1(−), B+, D3(−), B4, . . . , Dm−1(−), B+ are generated from the output buffer circuit 26.

Figure 19:
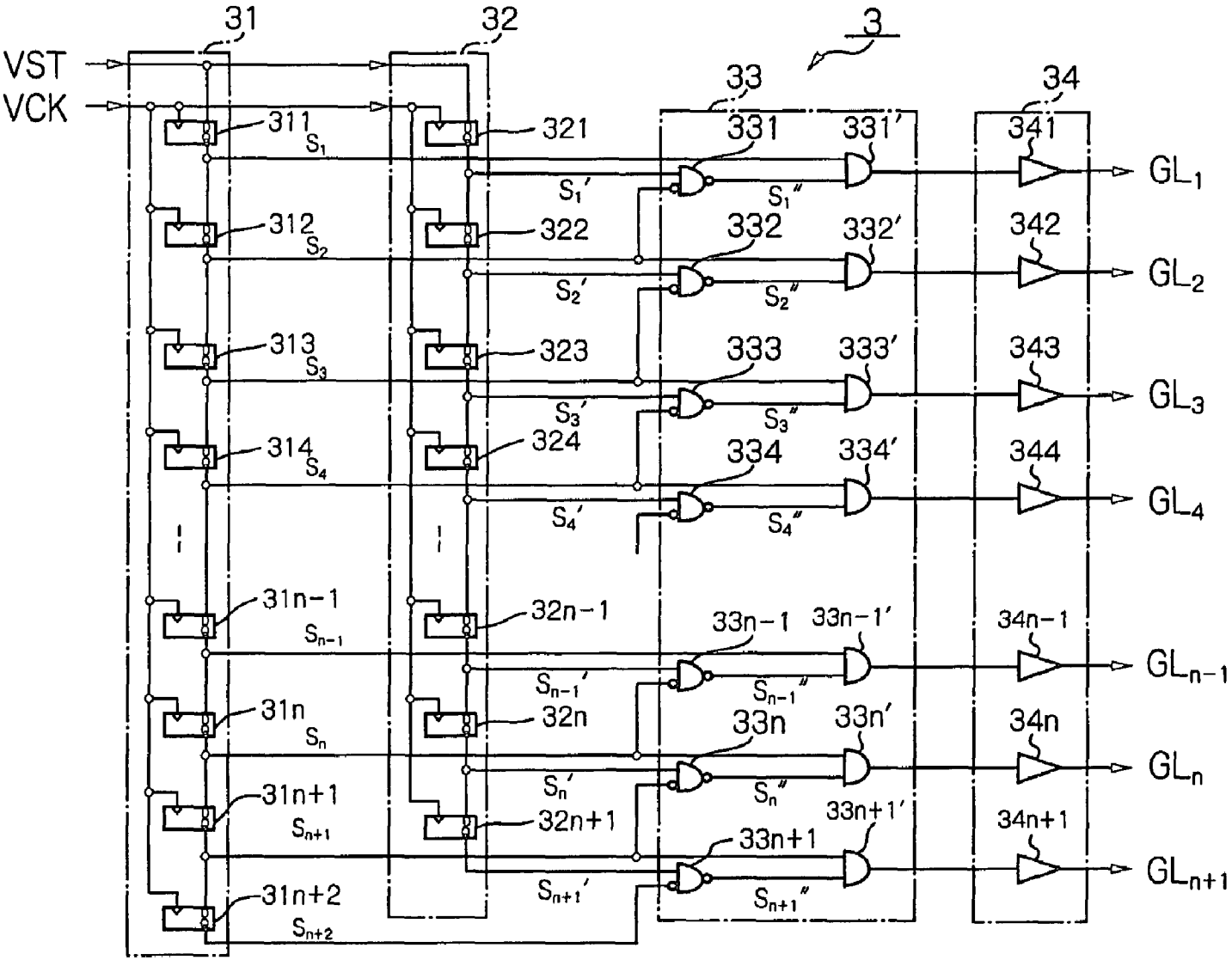
FIG. 19 is a detailed circuit diagram of the gate line driver circuit of FIG. 16.
Figure 20:
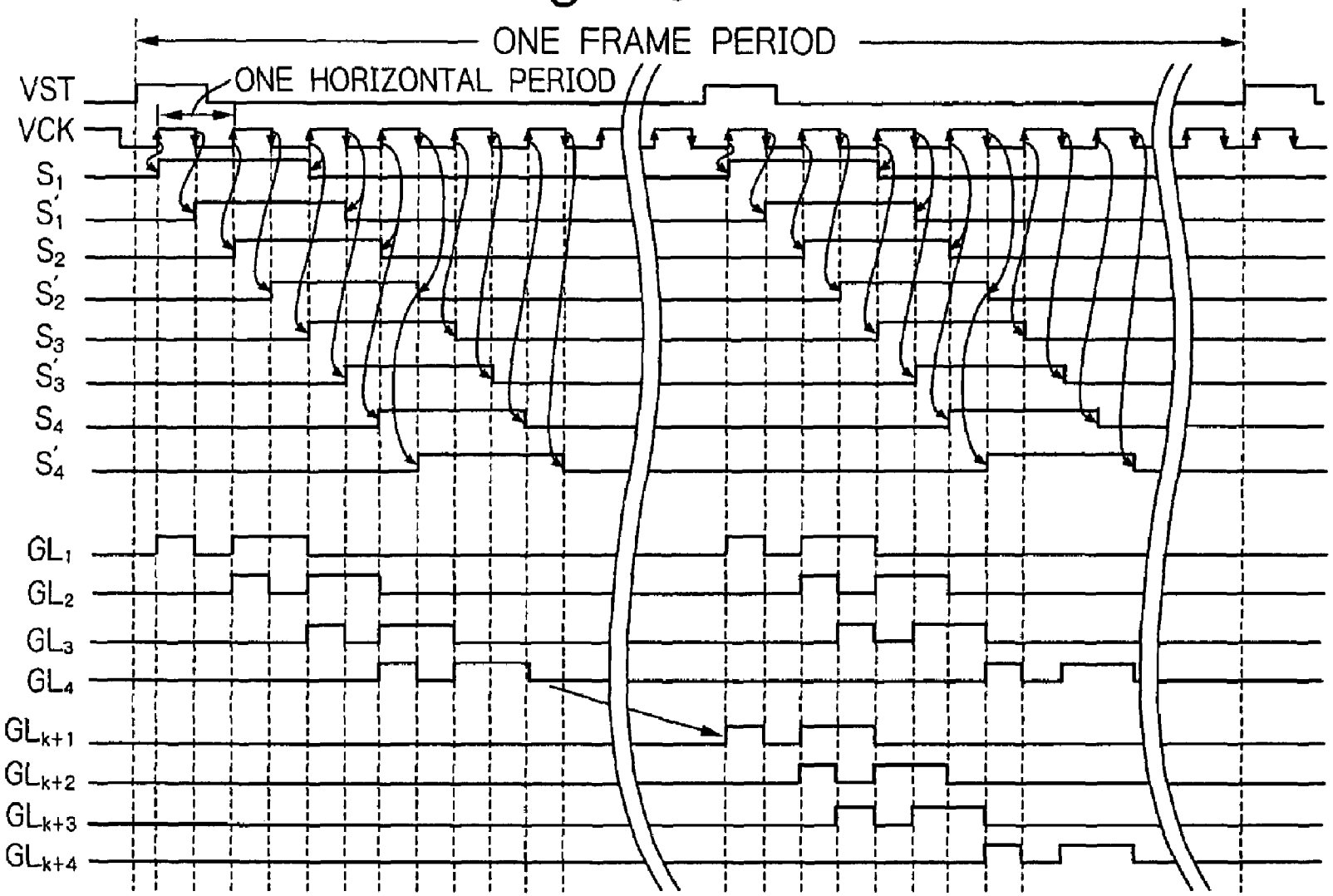
FIG. 20 is a timing diagram for explaining the operation of the gate line driver circuit of FIG. 19.

In FIG. 19, which illustrates a detailed circuit diagram of the gate line driver circuit 2 of FIG. 16, the gate line driver circuit 3 is constructed by shift register circuits 31 and 32 for shifting a vertical start pulse signal VST as shown in FIG. 20 in synchronization with a vertical clock signal VCK as shown in FIG. 20, a gate circuit 33 and an output buffer circuit 34 formed by amplifiers 341, 342, 343, 344, . . . , 34*n*−1, 34*n*. Note that two vertical start pulse signals VST are generated per one frame period.

The shift register circuit 31 is formed by serially-connected D-type flip-flops 311, 312, 313, 314, . . . , 31*n*−1, 30*n*, 31*n*+1, 31*n*+2 clocked by rising edges of the vertical clock signal VCK to generate signals $S_1$, $S_2$, $S_3$, $S_4$, . . . , $S_{n-1}$, $S_n$, $S_{n+1}$, $S_{n+2}$ as shown in FIG. 20.

The shift register circuit 32 is formed by serially-connected D-type flip-flops 321, 322, 323, 324, . . . , 32*n*−1, 32*n*, 32*n*+1 clocked by falling edges of the vertical clock signal VCK to generate signals $S_1'$, $S_2'$, $S_3'$, $S_4''$, . . . , $S_{n-1}'$, $S_n''$, $S_{n+1}'$ as shown in FIG. 20.

The gate circuit 33 is formed by a gate 331 for receiving the signals $S_1'$ and $S_2$, a gate 332 for receiving the signals $S_2'$ and $S_3$, a gate 333 for receiving the signals $S_3'$ and $S_4$, a gate 334 for receiving the signals $S_4'$ and $S_5$, . . . , a gate 33*n*−1 for receiving the signals $S_{n-1}'$ and $S_n$, a gate 33*n* for receiving the signals $S_n'$ and $S_{n+1}$, and a gate 33*n*−1 for receiving the signals $S_{n+1}'$ and $S_{n+2}$. Also, the gate circuit 33 is formed by a gate 331' for receiving the signal $S_1$ and an output signal $S_1''$ of the gate 331, a gate 332' for receiving the signal $S_2$ and an output signal $S_2''$ of the gate 332, a gate 333' for receiving the signal $S_3$ and an output signal $S_3''$ of the gate 333, a gate 334' for receiving the signal $S_4$ and an output signal $S_4''$ of the gate 334, . . . , a gate 33*n*−1' for receiving the signal $S_{n-1}$ and an output signal $S_{m-1}''$ of the gate 33*n*−1, a gate 33*n*' for receiving the signal $S_n$ and an output signal $S_n''$ of the gate 33*n*, and a gate 33*n*−1' for receiving the signal $S_{n+1}$ and an output signal $S_{n+1}''$ of the gate 33*n*−1.

Thus, the gate circuit 33 generates gate line signals (or scan line signals) on the gate lines $GL_1$, $GL_2$, $GL_3$, $GL_4$, . . . , $GL_{n-1}$, $GL_n$, $GL_{n+1}$, respectively, as shown in FIG. 20.

As shown in FIG. 20, two vertical start pulse signals VST are generated per one frame period. A first one of the vertical start pulse signals VST is used for writing black data, while a second one of the vertical start pulse signals VST is used for writing video data.

Figure 21:
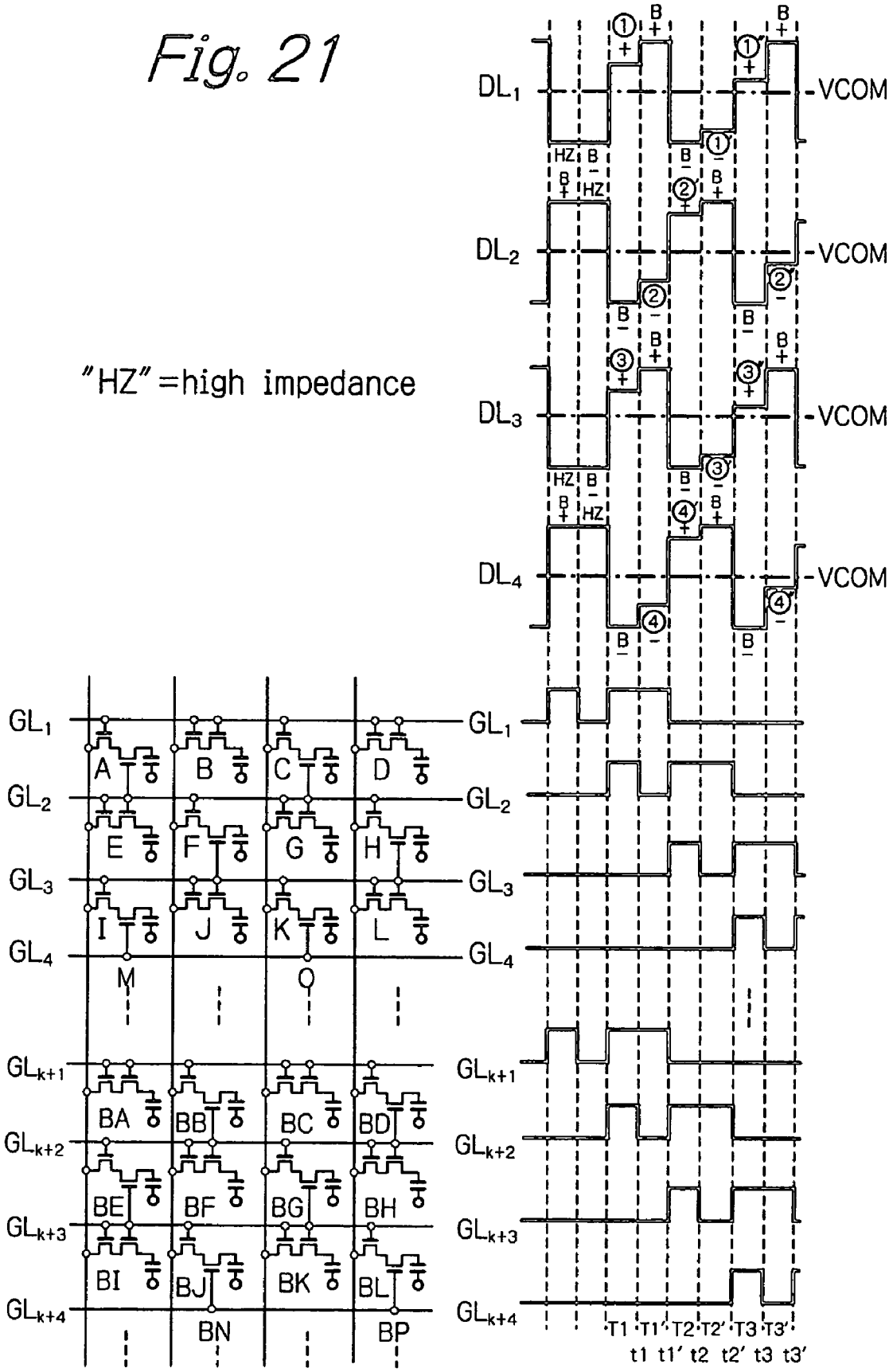
FIG. 21 is a timing diagram for explaining the operation of the LCD apparatus of FIG. 16.
Figure 22:
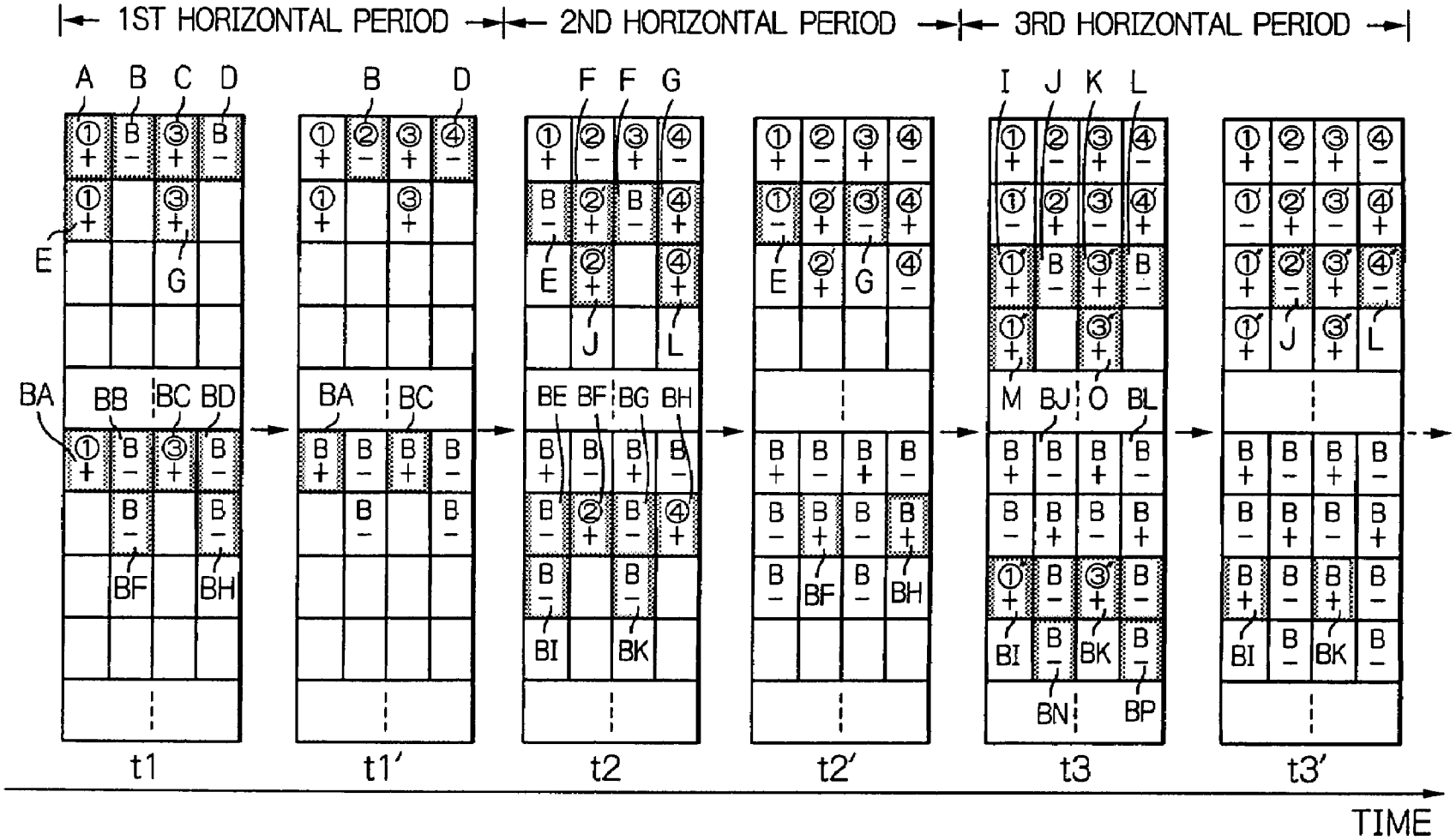
FIG. 22 is a timing diagram for supplementally explaining the operation of FIG. 21.

As illustrated in FIG. 21, in the former half T1 of a first frame period, when video data ①+ and ③+ are supplied to the data lines $DL_1$ and $DL_3$, respectively, and black data B− is supplied to the data lines $DL_2$ and $DL_4$ while the gate line signals at the gate lines $GL_1$, $GL_2$, $GL_{k+1}$ and $GL_{k+2}$ are high, the video data ①+ is written into pixels A, E and BA, the video data ③+ is written into pixels C, G and BC, and black data B− is written into pixels B, D, BB, BD, BF and BH, at time t1 as illustrated in FIG. 22. Subsequently, in the latter half T1' of the first frame period, when video data ②− and ④− and supplied to the data lines $DL_2$ and $DL_4$, respectively, and black data B+ is supplied to the data lines $DL_1$ and $DL_3$ while the gate line signals at the gate lines $GL_1$ and $GL_{k+1}$ are high, the video data ②− is written into pixel B, the video data ④− is written into pixel D, and black data B+ is written into pixels BA and BC, at time t1' as illustrated in FIG. 22.

Next, in the former half T2 of a second frame period, when video data ②'+ and ④'+ are supplied to the data lines $DL_2$ and $DL_4$, respectively, and black data B− is supplied to the data lines $DL_1$ and $DL_3$ while the gate line signals at the gate lines $GL_2$, $GL_3$, $GL_{k+2}$ and $GL_{k+3}$ are high, the video data ②'+ is written into pixels F, J and BF, the video data ④'+ is written into pixels H, L and BH, and black data B− is written into pixels E, G, BE, BI, BG and BK, at time t2 as illustrated in FIG. 22. Subsequently, in the latter half T2' of the second frame period, when video data ①'− and ③'− and supplied to the data lines $DL_1$ and $DL_3$, respectively, and black data B+ is supplied to the data lines $DL_2$ and $DL_4$ while the gate line signals at the gate lines $GL_2$ and $GL_{k+2}$ are high, the video data ①'− is written into pixel E, the video data ③'− is written into pixel G, and black data B+ is written into pixels BF and BH, at time t2' as illustrated in FIG. 22.

Next, in the former half T3 of a third frame period, when video data ①"+ and ③"+ are supplied to the data lines $DL_1$ and $DL_3$, respectively, and black data B− is supplied to the data lines $DL_2$ and $DL_4$ while the gate line signals at the gate lines $GL_3$, $GL_4$, $GL_{k+3}$ and $GL_{k+4}$ are high, the video data ①"+ is written into pixels I, M and BI, the video data ③"+ is written into pixels K, O and BK, and black data B− is written into pixels J, L, BJ, BN, BL and BP, at time t3 as illustrated in FIG. 22. Subsequently, in the latter half T3' of the third frame period, when video data ②"− and ④"− and supplied to the data lines $DL_2$ and $DL_4$, respectively, and black data B+ is supplied to the data lines $DL_1$ and $DL_3$ while the gate line signals at the gate lines $GL_3$ and $GL_{k+3}$ are high, the video data ②"− is written into pixel J, the video data ④"− is written into pixel L, and black data B+ is written into pixels BI and BK, at time t3' as illustrated in FIG. 22.

Thereafter, the same operation as described above is repeated.

Thus, in the same way as in the second prior art LCD apparatus of FIG. 10, a black region having a width of k gate lines where k=1, 3, 5, . . . is scanned to suppress the residual image phenomenon.

In the LCD apparatus of FIG. 16, since the data line driver circuit 2 of FIG. 17 has a smaller configuration than the data line driver circuit 12 of FIG. 2, the data line driver circuit 2 can be small in size, so that the integration can be enhanced. Also, since the output buffer circuit 26 of FIG. 17 has half the number of power consuming amplifiers as that of the data lines $DL_1$, $DL_2$, . . . , $DL_m$, the power consumption can be remarkably reduced.

Figure 23:
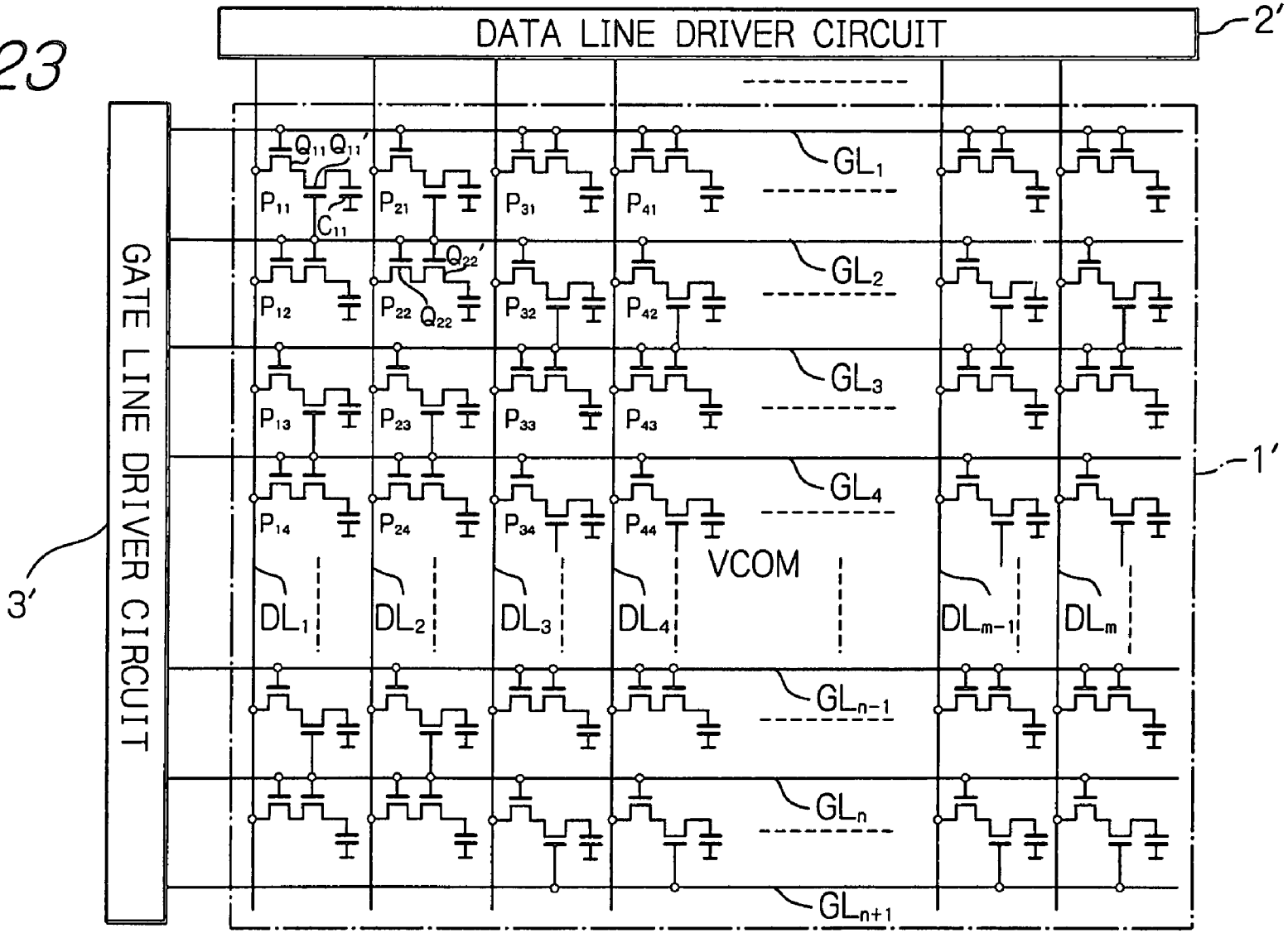
FIG. 23 is a block circuit diagram illustrating a second embodiment of the LCD apparatus according to the present invention.

In FIG. 23, which illustrates a second embodiment of the LCD apparatus according to the present invention, the LCD panel 1 of FIG. 16 is replaced by an LCD panel 1' where the first type of two consecutive pixels $P_{ij}$ (i=1, 2, 5, 6, . . . under j=1, 3, 5, . . . , and i=3, 4, 7, 8, . . . under j=2, 4, 6, . . . ) and the second type of two consecutive pixels $P_{ij}$ (i=3, 4, 7, 8, . . . under j=1, 3, 5, . . . , and i=1, 2, 5, 6, . . . under j=2, 4, 6, are staggered. That is, two first type pixels $P_{ij}$ and two second type pixels $P_{ij}$ are alternately arranged in rows, columns.

Each of the first type pixels $P_{ij}$ is the same as those of FIG. 16. That is, the gate of the TFT $Q_{ij}$ such as $Q_{11}$ is connected to the gate line $GL_j$ such as $GL_1$ and the gate of the TFT $Q_{ij}'$ such as $Q_{11}'$ is connected to the gate line $GL_{j+1}$ such as $GL_2$. Therefore, when the voltages at the gate lines $GL_j$ and $GL_{j+1}$ are both high, video data or black data is supplied from the data line $DL_i$ to the first type pixel $P_{ij}$.

Also, each of the second type pixels $P_{ij}$ is the same as those of FIG. 16. That is, the gates of the TFT $Q_{ij}$ and $Q_{ij}'$ such as $Q_{22}$ and $Q_{22}'$ are both connected to the gate line $GL_j$ such as $GL_2$. Therefore, when the voltage at the gate line $GL_j$ is high, video data or black data is supplied from the data line $DL_i$ to the second type pixel $P_{ij}$.

Figure 24:
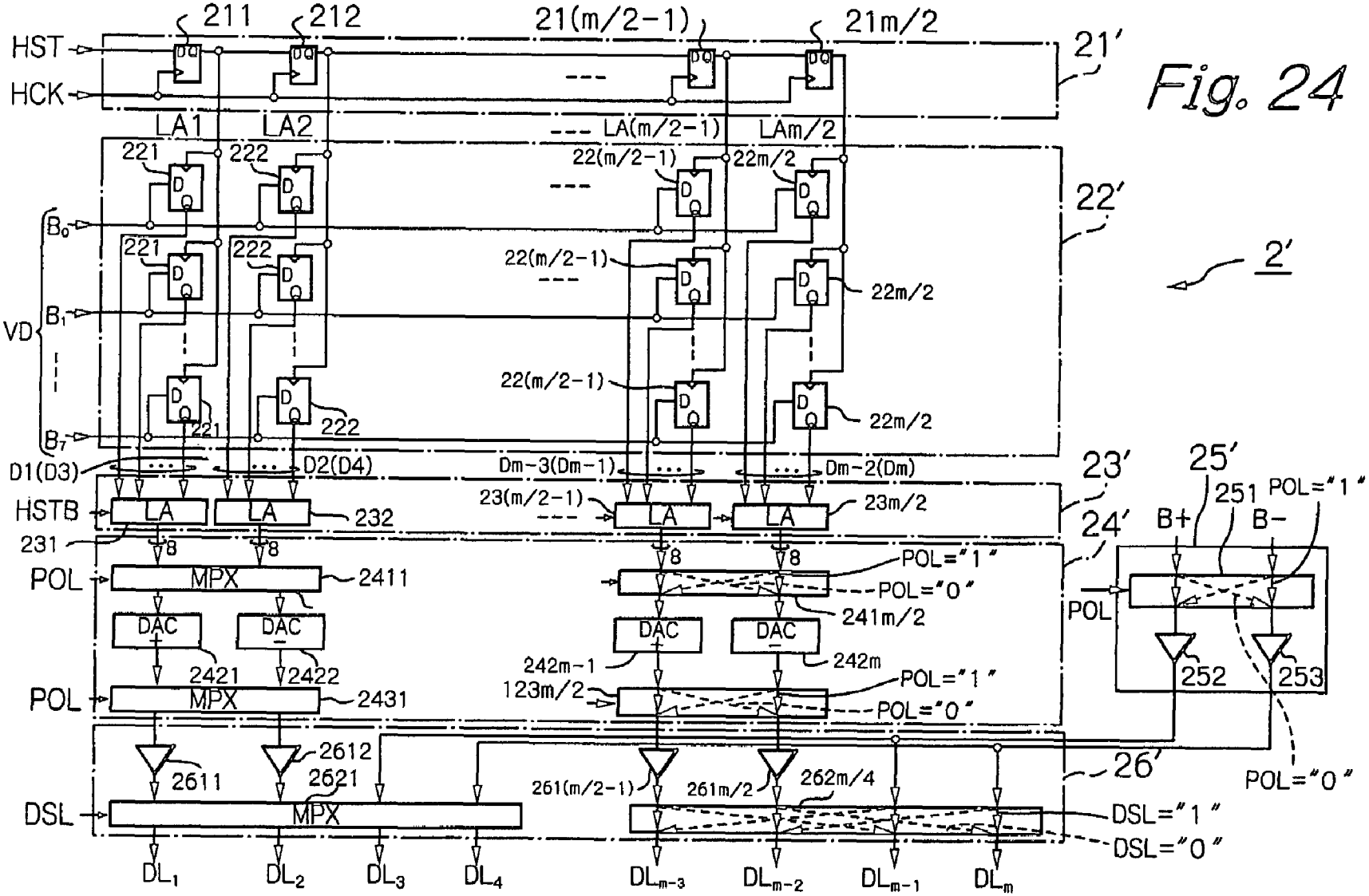
FIG. 24 is a detailed circuit diagram of the data line driver circuit of FIG. 23.

Also, in FIG. 23, the data line driver circuit 2 of FIG. 16 is replaced by a data line driver circuit 2' which is illustrated in FIG. 24 in detail.

In FIG. 17, the data line driver circuit 2' is constructed by a shift register circuit 21', a data register circuit 22', a data latch circuit 23', a D/A conversion circuit 24', a black data voltage generation circuit 25', and an output buffer circuit 26'.

Figure 25:
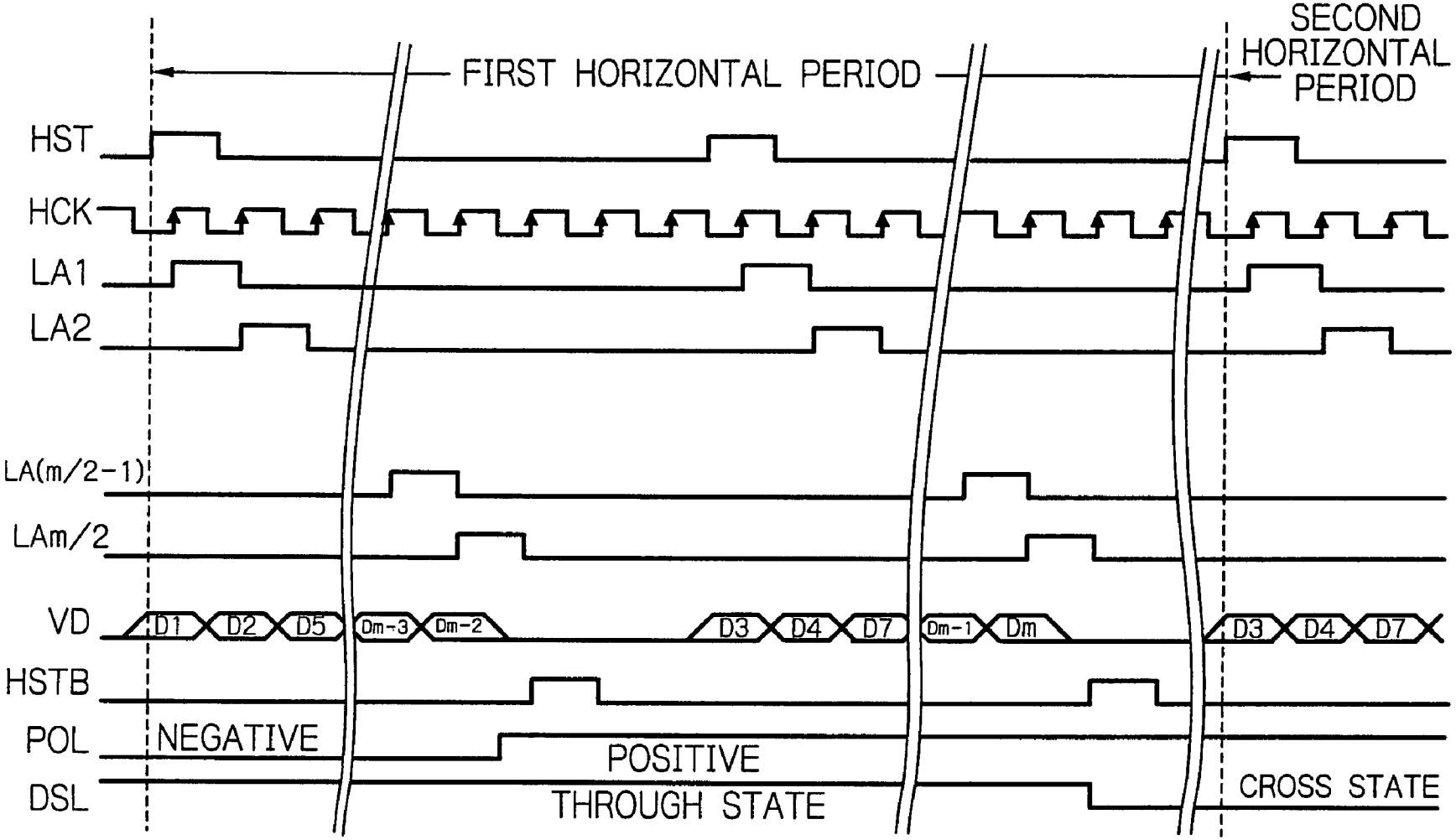
FIG. 25 is a timing diagram for explaining the operation of the data line driver circuit of FIG. 24.

The shift register circuit 21' shifts a horizontal start pulse signal HST as shown in FIG. 25 in synchronization a horizontal clock signal HCK as shown in FIG. 25. The shift register circuit 21' has the same configuration as the shift register circuit 21 of FIG. 17. That is, the shift register circuit 21' is formed by serially-connected D-type flip-flops 211, 212, . . . , 21(*m*/2−1), 21*m*/2 clocked by rising edges of the horizontal clock signal HCK to generate latch signals LA1, LA2, . . . LA(m/2−1), LAm/2, sequentially as shown in FIG. 25.

The data register circuit 22' latches an 8-bit gradation video data signal VD represented by $B_0$, $B_1$, . . . , $B_7$ in accordance with the latch signals LA1, LA2, . . . , LA(m/2−1), LAm/2. The data register circuit 22' has the same configuration as the data register circuit 22 of FIG. 17. That is, the data register circuit 22' is formed by 8 D-type flip-flops 221 clocked by the latch signal LA1 to latch digital video data D1 or D3 of the gradation video signal VD as shown in FIG. 25, 8 D-type flip-flops 222 clocked by the latch signal LA2 to latch digital video data D3 or D4 of the gradation video signal VD as shown in FIG. 25, . . . , 8 D-type flip-flops 22 (m/2−1) clocked by the latch signal LA(m/2−1) to latch digital video data Dm−3 or Dm−2 of the gradation video signal VD as shown in FIG. 25, and 8 D-type flip-flops 22 clocked by the latch signal LAm/2 to latch digital video data Dm−2 or Dm of the gradation video signal VD as shown in FIG. 25. In this case, the digital video data D1, D2, D5, . . . , Dm−3, Dm−2, D3, D4, D7, . . . , Dm−1, Dm of the 8 bit gradation video signal VD are sequentially generated from a signal processing circuit (not shown). In more detail, in a first horizontal period, the digital video data D1, D2, D5, . . . , Dm−3, Dm−2, D3, D4, D7, . . . , Dm−1, Dm are sequentially generated, and in a second horizontal period, alternately with the first horizontal period, the digital video data D3, D4, D7, . . . Dm−1, Dm, D1, D2, D5, . . . , Dm−3, Dm−2 are sequentially generated.

The data latch circuit 23' latches the digital video data D1 or D3, D2 or D4, . . . , Dm−3 or Dm−1, Dm−2 or Dm. The data latch circuit 23' has the same configuration as the data latch circuit 23 of FIG. 17. That is, the data latch circuit 23' is formed by latch circuits 231, 232, . . . , 23(*m*/2−1), 23*m*/2 clocked by a horizontal strobe signal HSTB as shown in FIG. 25 which is generated from the horizontal timing generating circuit.

The D/A conversion circuit 24' has the same configuration as the D/A conversion circuit 24 of FIG. 17. That is, the D/A conversion circuit 24' is formed by multiplexers 2411, . . . , 241*m*/2 clocked by a polarity signal POL as shown in FIG. 25, positive-side D/A converters 2421, . . . , 242*m*−1 for generating analog gradation voltages on the positive side with respect to the common voltage VCOM, negative-side D/A converters 2422, . . . , 242*m* for generating analog gradation voltages on the negative side with respect to the common voltage VCOM, and multiplexers 2431, 2432, . . . , 243*m*/2 clocked by the polarity signal POL. That is, if POL="1", the positive-side D/A converters 2421, . . . , 242*m*−1 are selected by the multiplexers 2411, . . . , 241*m*/2 and the multiplexers 2431, . . . , −, 243*m*/2. As a result, the D/A conversion circuit 24' generates positive polarity analog video signals corresponding to the digital video signals D1 or D3,. D2 or D4, . . . , Dm−3 or Dm−1, Dm−2 or Dm, respectively, and transmits them to the output buffer circuit 26'. On the other hand, if POL="0", the negative-side D/A converters 2422, . . . , 242*m* are selected by the multiplexers 2411, . . . , 241*m*/2 and the multiplexers 2431, . . . , 243*m*/2. As a result, the D/A conversion circuit 24' generates negative polarity analog video signals corresponding to the digital video signals D1 or D3, D2 or D4, . . . , Dm−3 or Dm−1, Dm−2 or Dm, respectively, and transmits them to the output buffer circuit 26.

The black data voltage generation circuit 25' is similar to the black data voltage generation circuit 25 of FIG. 17. That is, the black data voltage generation circuit 25' is formed by a multiplexer 251 clocked by the polarity signal POL and amplifiers 252 and 253. The multiplexer 251 operates in the same way as the multiplexers 2411, . . . , 241*m*/2 and the multiplexers 2431, . . . , 243*m*/2. Therefore, if POL="1", black data B+ and B− are amplified and transmitted to the output buffer circuit 26'. On the other hand, if POL="0", black data B− and B+ are amplified and transmitted to the output buffer circuit 26'.

The output buffer circuit 26' multiplexes the analog video signals from the D/A conversion circuit 24' and the black data voltage B+ or B− in accordance with a data selection signal DSL which is generated from the horizontal timing generating circuit.

The output buffer circuit 26' is similar to the output buffer circuit 26 of FIG. 17. That is, the output buffer circuit 26' is formed by amplifiers 2611, 2612, . . . , 261($m$/2−1), 261$m$/2 for amplifying the analog video signals from the multiplexers 2431, . . . , 243$m$/2, of the D/A conversion circuit 24' and multiplexers 2621, . . . , 262$m$/4 clocked by the data selection signal DSL. In this case, if DSL="1", the multiplexers 2621, . . . , 262$m$/4 are in a through state, while, if DSL="0", the multiplexers 2621, 262$m$/4 are in a cross state.

Therefore, in a first horizontal period, when POL="1" (positive) and DSL="1" (through state), signals D1(+), D2(−), B+, B−, . . . , Dm−3(+), Dm−2(−), B+, B− and generated from the output buffer circuit 26', and subsequently, when POL="1" (positive) and DSL="0" (cross state), signals B+, B−, D3(+), D4, . . . , B+, B−, Dm−1(+), Dm(−) are generated from the output buffer circuit 26'.

Therefore, in a second horizontal period, when POL="0" (negative) and DSL="0" (cross state), signals B−, B+, D3 (−), D4(+), . . . , B−, B+, Dm−1(−), Dm(+) are generated from the output buffer circuit 26', and subsequently, when POL="0" (negative) and DSL="1" (through state), signals D1(−), D2(+), B−, B+, . . . , Dm−3(−) Dm−2(+), B−, B+ are generated from the output buffer circuit 26'.

Note that the gate line driver circuit 3 has the same configuration as that of FIG. 17.

Figure 26:
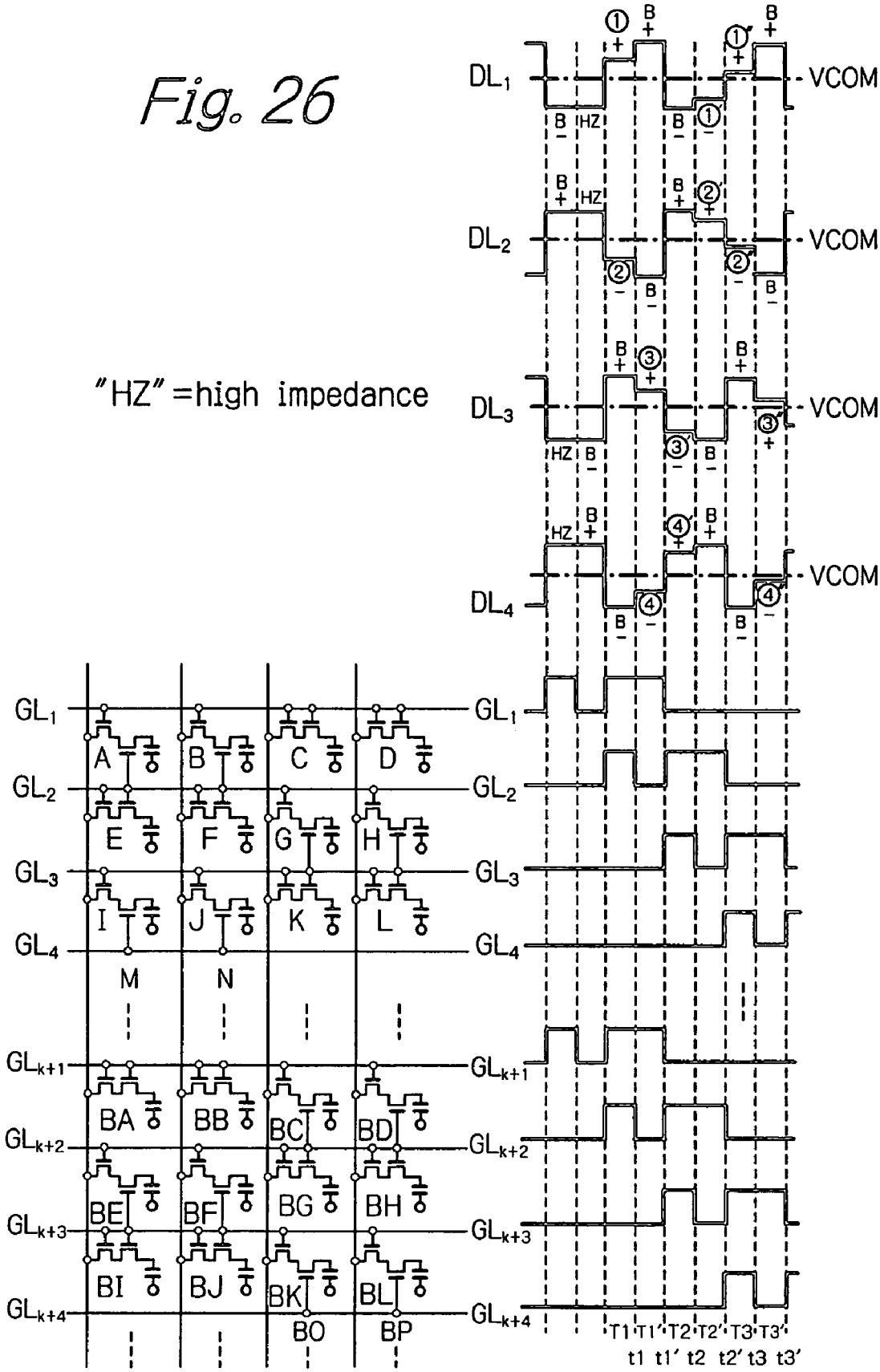
FIG. 26 is a timing diagram for explaining the operation of the LCD apparatus of FIG. 23.
Figure 27:
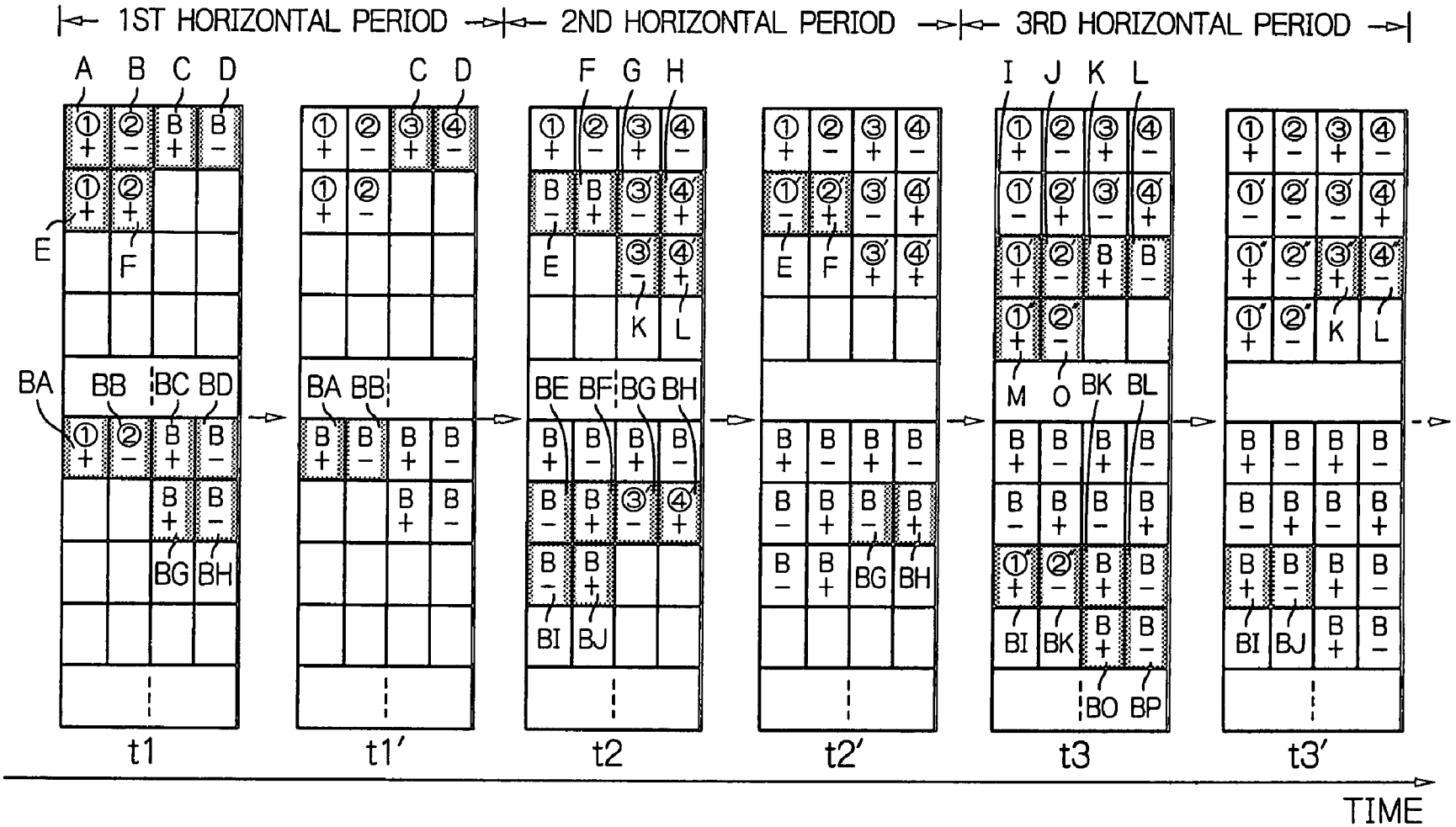
FIG. 27 is a timing diagram for supplementally explaining the operation of FIG. 26.

As illustrated in FIG. 26, in the former half T1 of a first frame period, when video data ①+ and ②− are supplied to the data lines $DL_1$ and $DL_2$, respectively, and black data B+ and B− and supplied to the data lines $DL_3$ and $DL_4$ while the gate line signals at the gate lines $GL_1$, $GL_2$, $GL_{k+1}$ and $GL_{k+2}$ are high, the video data ①+ is written into pixels A, E and BA, the video data ②− is written into pixels B, F and BB, black data B+ is written into pixels C, BC and BG, and black data B− is written into pixels D, BD and BH, at time t1 as illustrated in FIG. 27. Subsequently, in the latter half T1' of the first frame period, when video data ③+ and ④− and supplied to the data lines $DL_3$ and $DL_4$, respectively, and black data B+ and B− and supplied to the data lines $DL_1$ and $DL_2$ while the gate line signals at the gate lines $GL_1$ and $GL_{k+1}$ are high, the video data ③+ is written into pixel C, the video data ④− is written into pixel D, black data B+ is written into pixel BA, and black data B− is written into pixel BB at time t1' as illustrated in FIG. 27.

Next, in the former half T2 of a second frame period, when video data ③'− and ④'+ are supplied to the data lines $DL_3$ and $DL_4$, respectively, and black data B− and B+ are supplied to the data lines $DL_1$ and $DL_2$ while the gate line signals at the gate lines $GL_2$, $GL_3$, $GL_{k+2}$ and $GL_{k+3}$ are high, the video data ③'− is written into pixels G, K and BG, the video data ④'+ is written into pixels G, L and BH, black data B− is written into pixels E, BE and BI, and black data B+ is written into pixels F, BF and BJ at time t2 as illustrated in FIG. 27. Subsequently, in the latter half T2' of the second frame period, when video data ①'− and ②'+ are supplied to the data lines $DL_1$ and $DL_2$, respectively, and black data B− and B+ are supplied to the data lines $DL_3$ and $DL_4$ while the gate line signals at the gate lines $GL_2$ and $GL_{k+2}$ are high, the video data ①'− is written into pixel E, the video data ②'+ is written into pixel F, black data B+ is written into pixel BG, and black data B+ is written into pixels BH, at time t2' as illustrated in FIG. 27.

Next, in the former half T3 of a third frame period, when video data ①"+ and ②"− and supplied to the data lines $DL_1$ and $DL_2$, respectively, and black data B+ and B− and supplied to the data lines $DL_3$ and $DL_4$ while the gate line signals at the gate lines $GL_3$, $GL_4$, $GL_{k+3}$ and $GL_{k+4}$ are high, the video data ①"+ is written into pixels I, KM and I, the video data ②"− is written into pixels J, O and BK, black data B+ is written into pixels K, BK and BO, and black data B− is written into pixels L, BL and BP, at time t3 as illustrated in FIG. 27. Subsequently, in the latter half T3' of the third frame period, when video data ③"+ and ④"− and supplied to the data lines $DL_3$ and $DL_4$, respectively, and black data B+ and B− and supplied to the data lines $DL_1$ and $DL_2$ while the gate line signals at the gate lines $GL_3$ and $GL_{k+3}$ are high, the video data ③"+ is written into pixel K, the video data ④"− is written into pixel L, black data B+ is written into pixel BI, and black data B− is written into pixel BJ, at time t3' as illustrated in FIG. 27.

Thereafter, the same operation as described above is repeated.

Thus, in the same way as in the second prior art LCD apparatus of FIG. 10, a black region having a width of k gate lines where k=1, 3, 5, . . . is scanned to suppress the residual image phenomenon.

Even in the LCD apparatus of FIG. 23, since the data line driver circuit 2' of FIG. 24 has a smaller configuration than the data line driver circuit 12 of FIG. 2, the data line driver circuit 2' can be small in size, so that the integration can be enhanced. Also, since the output buffer circuit 26' of FIG. 24 has half the number of power consuming amplifiers as that of the data lines $DL_1$, $DL_2$, . . . , $DL_m$, the power consumption can be remarkably reduced.

In the above-described embodiments, although the black data voltage B+ or B− is set to be a maximum voltage or a minimum voltage in a normal white type LCD apparatus, the present invention can be applied to a normal black type LCD apparatus where the black data voltage B+ or B− is set to be the common voltage VCOM.

Also, in the above-described embodiments, the second type pixel includes two TFTs connected to one gate line; however, this second type pixel can include one TFT whose ON resistance is equivalent to the two TFTs.

Further, in the above-described embodiments, the locations of the first type pixels and the locations of the second type pixels can be exchanged with each other. In this case, the operation for the first horizontal period and the operation for the second horizontal period are exchanged with other.

Still, in the above-described embodiments, one or two first type pixels and one or two second type pixels are staggered; however, three or more first type pixels and three or more second type pixels can be staggered.

Furthermore, in the above-described embodiments, inversion methods other than the dot inversion method can be adopted.

Additionally, the present invention can be applied to hold type image display apparatuses other than an LCD apparatus, such as an electroluminescence (EL) display apparatus.

As explained hereinabove, according to the present invention, the data line driver circuit can be small in size and its power consumption can be reduced.

The invention claimed is:

1. A hold type image display apparatus comprising:

a panel including a plurality of data lines, a plurality of gate lines, and first and second type pixels located at intersections between said data lines and said gate lines, every one or more of said first type pixels and every one or more of said second type pixels being staggered at said intersections, wherein each of said first type pixels is connected to one of said data lines and two successive ones of said gate lines, and each of said second type pixels is connected to one of said data lines and one of said gate lines;

a gate line driver circuit, connected to said gate lines, for scanning two first successive ones of said gate lines for writing first video data and two second successive ones of said gate lines for writing first black data in a first selection period and for scanning a preceding one of said first successive gate lines for writing second video data and a preceding one of said second successive gate lines for writing second black data in a second selection period; and a data line driver circuit, connected to said data lines, for supplying said first video data and said first black data to said data lines in said first selection period and for supplying said second video data and said second black data to said data lines in said second selection period.

2. The hold type image display apparatus as set forth in claim 1, wherein each of said first type pixels comprises:

a first pixel capacitor including liquid crystal; and first and second thin film transistors connected in series between one of said data lines and said first pixel capacitor, said first and second thin film transistors having respective gates connected to two successive ones of said gate lines, each of said second type pixels comprising:

a second pixel capacitor including liquid crystal; and third and fourth thin film transistors connected in series between one of said data lines and said second pixel capacitor, said third and fourth thin film transistors having respective gates connected to one of said gate lines.

3. The hold type image display apparatus as set forth in claim 1, wherein each of said first type pixels comprises:

a first pixel capacitor including liquid crystal; and first and second thin film transistors connected in series between one of said data lines and said first pixel capacitor, said first and second thin film transistors having respective gates connected to two successive ones of said gate lines, each of said second type pixels comprising:

a second pixel capacitor including liquid crystal; and a third thin film transistor connected between one of said data lines and said second pixel capacitor, said third thin film transistor having a gate connected to one of said gate lines, an ON resistance of said third thin film transistor being equivalent to an ON resistance of said first and second thin film transistors.

4. The hold type image display apparatus as set forth in claim 1, wherein a difference in a number of said gate lines between said two first successive gate lines and said two second successive gate lines is k where k is 1, 3, 5, . . . .

5. The hold type image display apparatus as set forth in claim 1, wherein said gate line driver circuit comprises:

first and second shift register circuits for receiving two vertical start pulse signals per one frame period to shift said vertical start pulse signals in synchronization with a vertical clock signal, said first shift register circuit including serially-connected first flip-flops clocked by rising edges of said vertical clock signal to generate first signals, said second shift register circuit including serially-connected second flip-flops clocked by falling edges of said vertical clock signal to generate second signals;

a gate circuit, connected to said first and second shift register circuits, for receiving said first and second signals to generate scanning signals for scanning said two first successive gate lines and said two second successive gate lines; and an output buffer circuit, connected to said gate circuit, for amplifying said scanning signals.

6. The hold type image display apparatus as set forth in claim 1, wherein said first and second selection periods form one horizontal period, a sequence of said first video data and said first black data being opposite to a sequence of said second video data and said second black data.

7. The hold type image display apparatus as set forth in claim 6, wherein polarities of said first video data and said first black data are opposite to those of said second video data and said second black data.

8. The hold type image display apparatus as set forth in claim 1, wherein said data line driver circuit comprises:

a shift register circuit for receiving two horizontal start pulse signals per one horizontal period to shift said two horizontal start pulse signals in synchronization with a horizontal clock signal, said shift register circuit including serially-connected third flip-flops clocked by said horizontal clock signal to generate latch signals, the number of said third flip-flops being half of the number of said data lines;

a data register circuit, connected to said shift register circuit, for latching said first and second video data in synchronization with said latch signals;

a digital/analog conversion circuit, connected to said data register circuit, for performing digital/analog conversions upon said first and second video data latched in said data register circuit;

a black data voltage generation circuit for generating at least one black data; and an output buffer circuit, connected to said digital/analog conversion circuit and said black data voltage generation circuit, for multiplexing and supplying said first and second video data and said black data to said data lines.

9. The hold type image display apparatus as set forth in claim 8, wherein said output buffer circuit includes a plurality of amplifiers for amplifying said analog first and second video data voltages, the number of said amplifiers being half of the number of said data lines.

10. The hold type image display apparatus as set forth in claim 8, wherein every one of said first type pixels and every one of said second type pixels are staggered at said intersections between said data lines and said gate lines, said digital/analog conversion circuit comprising:

a plurality of positive side digital/analog converters;

a plurality of negative side digital/analog converters; and multiplexers, connected to said positive side digital/analog converters and said negative side digital/analog converters, for selecting said positive side digital/analog converters or said negative side digital/analog converters in accordance with a polarity signal, said black data voltage generation circuit selecting and generating negative side black data or positive side black data in accordance with said polarity signal.

11. The hold type image display apparatus as set forth in claim 10, wherein said output buffer circuit comprises a plurality of muliplexers, each connected to said digital/analog conversion circuit, said black data voltage generation circuit and two of said data line, for multiplexing said first and second video signals and said black data.

12. A panel used in a hold type image display apparatus, the panel comprising:

a plurality of data lines;

a plurality of gate lines; and first and second type pixels located at intersections between said data lines and said gate lines, every one or more of said first type pixels and every one or more of said second type pixels being staggered at said intersections both along said data lines and along said gate lines, wherein each of said first type pixels is connected to one of said data lines and two successive ones of said gate lines, and each of said second type pixels is connected to one of said data lines and one of said gate lines.

13. The panel as set forth in claim 12, wherein each of said first type pixels comprises:

a first pixel capacitor including liquid crystal; and first and second thin film transistor connected in series between one of said data lines and said first pixel capacitor, said first and second thin film transistors having respective gates connected to two successive ones of said gate lines, each of said second type pixels comprising:

a second pixel capacitor including liquid crystal; and third and fourth thin film transistors connected in series between one of said data lines and said second pixel capacitor, said third and fourth thin film transistors having respective gates connected to one of said gate lines.

14. The panel as set forth in claim 12, wherein each of said first type pixels comprises:

a first pixel capacitor including liquid crystal; and first and second thin film transistors connected in series between one of said data lines and said first pixel capacitor, said first and second thin film transistors having respective gates connected to two successive ones of said gate lines, each of said second type pixels comprising:

a second pixel capacitor including liquid crystal; and a third thin film transistor connected between one of said data lines and said second pixel capacitor, said third thin film transistor having a gate connected to one of said gate lines, an ON resistance of said third thin film transistor being equivalent to an ON resistance of said first and second thin film transistors.

15. A gate line driver circuit used in a hold type image display apparatus including a panel formed by a plurality of data lines, a plurality of gate lines, and first and second type pixels located at intersections between said data lines and said gate lines, every one or more of said first type pixels and every one or more of said second type pixels being staggered at said intersections, each of said first type pixels being connected to one of said data lines and two successive ones of said gate lines, each of said second type pixels being connected to one of said data lines and one of said gate lines, wherein said gate line driver circuit scans two first successive ones of said gate lines for writing first video data and two second successive ones of said gate lines for writing first black data in a first selection period and scans a preceding one of said first successive gate lines for writing second video data and a preceding one of said second successive gate lines for writing second black data in a second selection period.

16. The gate line driver circuit as set forth in claim 15, wherein a difference in a number of said gate fines between said two first successive gate lines and said two second successive gate lines is k where k is 1, 3, 5, . . . .

17. The gate line driver circuit as set forth in claim 15, comprising:

first and second shift register circuits for receiving two vertical start pulse signals per one frame period to shift said vertical start pulse signals in synchronization with a vertical clock signal, said first shift register circuit including serially-connected first flip-flops clocked by rising edges of said vertical clock signal to generate first signals, said second shift register circuit including serially-connected second flip-flops clocked by falling edges of said vertical clock signal to generate second signals;

a gate circuit, connected to said first and second shift registers, for receiving said first and second signals to generate scanning signals for scanning said two first successive gate lines and said two second successive gate lines; and an output buffer circuit, connected to said gate circuit, for amplifying said scanning signals.

18. A data line driver circuit used in a hold type image display apparatus including a panel formed by a plurality of data lines, a plurality of gate lines, and first and second type pixels located at intersections between said data lines and said gate lines, every one or more of said first type pixels and every one or more of said second type pixels being staggered at said intersections, each of said first type pixels being connected to one of said data lines and two successive ones of said gate lines, each of said second type pixels being connected to one of said data lines and one of said gate lines, wherein said data line driver circuit supplies first video data and first black data to said data lines in a first selection period and supplies second video data and second black data to said data lines in a second selection period.

19. The data line driver circuit as set forth in claim 18, wherein said first and second selection periods form one horizontal period, a sequence of said first video data and said first black data being opposite to a sequence of said second video data and said second black data.

20. The data line driver circuit as set forth in claim 19, wherein polarities of said first video data and said first black data are opposite to those of said second video data and said second black data.

21. The data line driver circuit as set forth in claim 18, comprising:

a shift register circuit for receiving two horizontal start pulse signals per one horizontal period to shift said two horizontal start pulse signals in synchronization with a horizontal clock signal, said shift register circuit including serially-connected third flip-flops clocked by said horizontal clock signal to generate latch signals, the number of said third flip-flops being half of the number of said data lines;

a data register circuit, connected to said shift register circuit, for latching said first and second video data in synchronization with said latch signals;

a digital/analog conversion circuit, connected to said data register circuit, for performing digital/analog conversions upon said first and second video data latched in said data register circuit;

a black data voltage generation circuit for generating at least one black data; and an output buffer circuit, connected to said digital/analog conversion circuit and said black data voltage generation circuit, for multiplexing and supplying said first and second video data and said black data to said data lines.

22. The data line driver circuit as set forth in claim 21, wherein said output buffer circuit includes a plurality of amplifiers for amplifying said analog first and second video data voltages, the number of said amplifiers being half of the number of said data lines.

23. The data line driver circuit as set forth in claim 21, wherein every one of said first type pixels and every one of said second type pixels are staggered at said intersections between said data lines and said gate lines, said digital/analog conversion circuit comprising:

a plurality of positive side digital/analog converters;

a plurality of negative side digital/analog converters; and multiplexers, connected to said positive side digital/analog converters and said negative side digital/analog converters, for selecting said positive side digital/analog converters or said negative side digital/analog converters in accordance with a polarity signal, said black data voltage generation circuit selecting and generating negative side black data or positive side black data in accordance with said polarity signal.

24. The data line driver circuit as set forth in claim 23, wherein said output buffer circuit comprises a plurality of muliplexers, each connected to said digital/analog conversion circuit, said black data voltage generation circuit and two of said data line, for multiplexing said first and second video signal and said black data.

25. A method for driving a hold type image display apparatus comprising: a panel including a plurality of data lines, a plurality of gate lines, and first and second type pixels located at intersections between said data lines and said gate lines, every one or more of said first type pixels and every one or more of said second type pixels being staggered at said intersections, wherein each of said first type pixels is connected to one of said data lines and two successive ones of said gate lines, and each of said second type pixels is connected to one of said data lines and one of said gate lines, said method comprising:

scanning two first successive ones of said gate lines for writing first video data and two second successive ones of said gate lines for writing first black data in a first selection period;

supplying said first video data and said first black data to said data lines in said first selection period;

scanning a preceding one of said first successive gate lines for writing second video data and a preceding one of said second successive gate lines for writing second black data in a second selection period; and supplying said second video data and said second black data to said data lines in said second selection period.

26. The method as set forth in claim 25, wherein a difference in a number of said gate lines between said two first successive gate lines and said two second successive gate lines is k where k is 1, 3, 5, . . . .

27. The method as set forth in claim 25, wherein said scanning comprises:

receiving two vertical start pulse signals per one frame period to shift said vertical start pulse signals in synchronization with a vertical clock signal, to generate first signals and second signals;

receiving said first and second signals to generate scanning signals for scanning said two first successive gate lines and said two second successive gate lines; and amplifying said scanning signals.

28. The method as set forth in claim 25, wherein said first and second selection periods form one horizontal period, a sequence of said first video data and said first black data being opposite to a sequence of said second video data and said second black data.

29. The method as set forth in claim 28, wherein polarities of said first video data and said first black data are opposite to those of said second video data and said second black data.

30. The method as set forth in claim 25, wherein said supplying comprises:

receiving two horizontal start pulse signals per one horizontal period to shift said two horizontal start pulse signals in synchronization with a horizontal clock signal;

latching said first and second video data in synchronization with latch signals;

performing digital/analog conversions upon said latched first and second video data;

generating at least one black data; and multiplexing and supplying said first and second video data and said black data to said data lines.

31. The method as set forth in claim 30, wherein every one of said first type pixels and every one of said second type pixels are staggered at said intersections between said data lines and said gate lines, said digital/analog performing comprising:

selecting a positive side digital/analog performing or a negative side digital/analog performing in accordance with a polarity signal; and selecting and generating negative side black data or positive side black data in accordance with said polarity signal.

* * * * *